US011482099B2

(12) United States Patent
White et al.

(10) Patent No.: US 11,482,099 B2
(45) Date of Patent: Oct. 25, 2022

(54) METHOD AND APPARATUS FOR PREVENTING TRAFFIC OVER-REPORTING VIA IDENTIFYING MISLEADING PROBE DATA

(71) Applicant: HERE Global B.V., Eindhoven (NL)

(72) Inventors: Donta White, Racine, WI (US); Leon Stenneth, Chicago, IL (US); Adekunle Afolabi, Aurora, IL (US)

(73) Assignee: HERE Global B.V., Eindhoven (NL)

( * ) Notice: Subject to any disclaimer, the term of this patent is extended or adjusted under 35 U.S.C. 154(b) by 80 days.

(21) Appl. No.: 17/165,612

(22) Filed: Feb. 2, 2021

(65) Prior Publication Data

US 2022/0246028 A1 Aug. 4, 2022

(51) Int. Cl.
*G08G 1/01* (2006.01)
*G08G 1/09* (2006.01)

(52) U.S. Cl.
CPC ..... *G08G 1/0125* (2013.01); *G08G 1/091* (2013.01)

(58) Field of Classification Search
CPC ..... G08G 1/0125; G08G 1/091; G08G 1/01; G08G 1/07; G08G 1/14; G08G 1/015; G08G 1/017
USPC ..... 340/907, 910; 701/400, 409, 414, 473
See application file for complete search history.

(56) References Cited

U.S. PATENT DOCUMENTS 6,577,946 B2 6/2003 Myr
9,235,988 B2 * 1/2016 Mimeault ..... G06V 10/255
9,355,560 B2 5/2016 Stenneth et al.
9,955,359 B2 4/2018 Monaghan et al.
9,965,950 B2 * 5/2018 Xu ..... G08G 1/0112
10,333,980 B2 6/2019 Ting et al.
10,573,173 B2 2/2020 Liu et al.
10,713,943 B1 * 7/2020 Mubarek ..... G07C 5/008
2019/0187723 A1 * 6/2019 Tao ..... G01C 21/3415
2020/0410856 A1 * 12/2020 Deruytter ..... H04W 80/02

FOREIGN PATENT DOCUMENTS

CN 110708673 A 1/2020

OTHER PUBLICATIONS

Wang et al., "Defending Against Sybil Devices in Crowdsourced Mapping Services", Publication: MobiSys '16 Proceedings of the 14th Annual International Conference on Mobile Systems, Applications, and Services, Jun. 2016 13 pages.

(Continued)

*Primary Examiner* — Eric Blount
(74) *Attorney, Agent, or Firm* — Ditthavong, Steiner & Mlotkowski

(57) ABSTRACT

An approach is provided for preventing traffic over-reporting via identifying misleading traffic data. The approach involves, for example, detecting a connection attempt between a wireless communication infrastructure device and a plurality of probe devices. The wireless communication infrastructure device is associated with a known height. The approach also involves processing one or more wireless signals associated with the connection attempt to determine height data of the plurality of probe devices. The approach further involves determining based on the height data that at least two of the plurality of probe devices are carried by a single entity. The approach further involves providing data indicating the at least two of the plurality of probe devices as an output.

20 Claims, 15 Drawing Sheets

(56) References Cited

OTHER PUBLICATIONS

Stenneth et al., "Transportation Mode Detection using Mobile Phones and GIS Information", Publication: GIS '11: Proceedings of the 19th ACM SIGSPATIAL International Conference on Advances in Geographic Information Systems, Nov. 2011, pp. 54-63.

* cited by examiner

100

Prior Art

FIG. 8

800

| Map features 801 (speed limit, signs (e.g., light poles), map features associated with wireless communication infrastructure device, etc.) | Mode of transport features 803 (make, model, sensors, etc.) | Mode of transport operation settings 805 (speed, sensor operations, AV mode, etc.) | User features 807 (age, height, stride, mobility patterns, etc.) | Environmental features 809 (weather, events, traffic, etc.) | Misleading traffic event categories 811 (e.g., different carrying entity categories, street portion categories, etc.) |
|---|---|---|---|---|---|
| $mf^1$ | $vf^1$ | $sf^1$ | $pf^1$ | $ef^1$ | a pedestrian |
| $mf^2$ | $vf^2$ | $sf^2$ | $pf^2$ | $ef^2$ | a vehicle rider |
| $mf^3$ | $vf^3$ | $sf^3$ | $pf^3$ | $ef^3$ | an autonomous vehicle |
| $mf^4$ | $vf^4$ | $sf^4$ | $pf^4$ | $ef^4$ | .... |

METHOD AND APPARATUS FOR PREVENTING TRAFFIC OVER-REPORTING VIA IDENTIFYING MISLEADING PROBE DATA

BACKGROUND

Navigation and mapping service providers are continually challenged to provide digital maps with traffic incident reports to support navigation applications and advanced applications such as autonomous driving. For example, providing users up-to-date data on traffic flow and traffic incidents (e.g., accidents or bottlenecks) can potentially reduce congestion and improve safety. However, traffic incident information can be manipulated. By way of example, an artist walked a handcart filled with smart phones down the street to cause a web mapping service's algorithm to report a traffic jam on the street. Therefore, map service providers face significant technical challenges to suppress such misleading traffic incident information.

SOME EXAMPLE EMBODIMENTS

As a result, there is a need for preventing traffic over-reporting via identifying misleading traffic data.

According to one or more example embodiments, a computer-implemented method comprises detecting a connection attempt between a wireless communication infrastructure device and a plurality of probe devices. The wireless communication infrastructure device is associated with a known height. The method also comprises processing one or more wireless signals associated with the connection attempt to determine height data of the plurality of probe devices. The method further comprises determining based on the height data that at least two of the plurality of probe devices are carried by a single entity. The method further comprises providing data indicating the at least two of the plurality of probe devices as an output.

According to another embodiment, an apparatus comprises at least one processor, and at least one memory including computer program code for one or more computer programs, the at least one memory and the computer program code configured to, with the at least one processor, cause, at least in part, the apparatus to detect a connection attempt between a wireless communication infrastructure device and a plurality of probe devices. The wireless communication infrastructure device is associated with a known height. The apparatus is also caused to process one or more wireless signals associated with the connection attempt to determine height data of the plurality of probe devices. The apparatus is further caused to determine based on the height data that at least two of the plurality of probe devices are carried by a single entity. The apparatus is further caused to provide data indicating the at least two of the plurality of probe devices as an output.

According to another embodiment, a non-transitory computer-readable storage medium carries one or more sequences of one or more instructions which, when executed by one or more processors, cause, at least in part, an apparatus to detect a connection attempt between a wireless communication infrastructure device and a plurality of probe devices. The wireless communication infrastructure device is associated with a known height. The apparatus is also caused to process one or more wireless signals associated with the connection attempt to determine height data of the plurality of probe devices. The apparatus is further caused to determine based on the height data that at least two of the plurality of probe devices are carried by a single entity. The apparatus is further caused to provide data indicating the at least two of the plurality of probe devices as an output.

According to another embodiment, an apparatus comprises means for detecting a connection attempt between a wireless communication infrastructure device and a plurality of probe devices. The wireless communication infrastructure device is associated with a known height. The apparatus also comprises means for processing one or more wireless signals associated with the connection attempt to determine height data of the plurality of probe devices. The apparatus further comprises means for determining based on the height data that at least two of the plurality of probe devices are carried by a single entity. The apparatus further comprises means for providing data indicating the at least two of the plurality of probe devices as an output.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings:

FIG. 8 is a diagram of an example machine learning data matrix, according to one or more example embodiments;

DESCRIPTION OF SOME EMBODIMENTS

Examples of a method, apparatus, and computer program for preventing traffic over-reporting via identifying misleading traffic data. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

Figure 1:
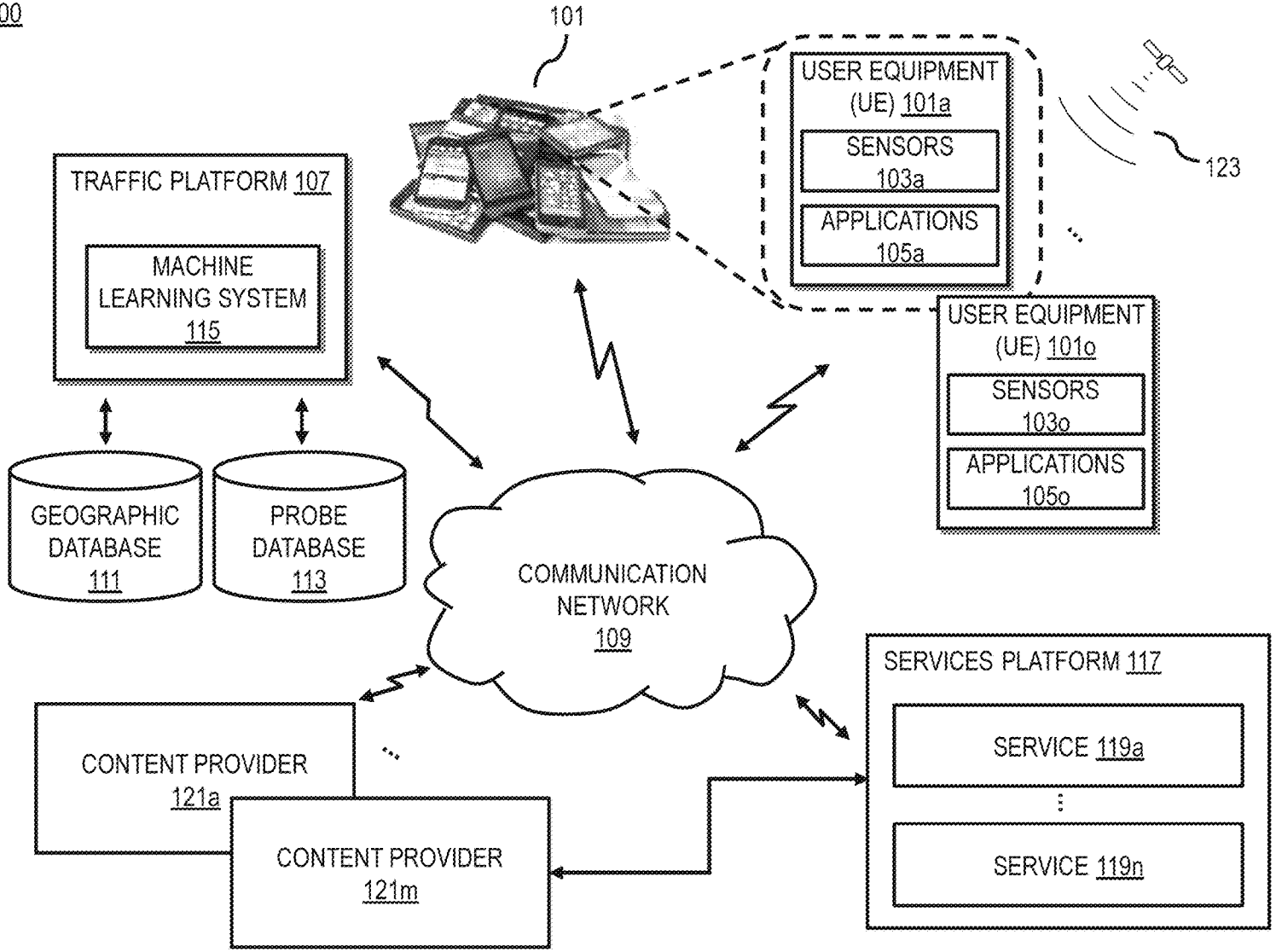
FIG. 1 is a diagram of a system capable of preventing traffic over-reporting via identifying misleading traffic data, according to one or more example embodiments.

FIG. 1 is a diagram of a system 100 capable of preventing traffic over-reporting via identifying misleading traffic data, according to one or more example embodiments. Map service providers can purchase probe data and/or location sensor data from data providers to build maps and create traffic products, etc. To create the traffic products, the Map service providers can map-match the probe data and/or location sensor data, determine respective speeds of the probe devices, and determine a travel/traffic speed on a road link. The computed travel/traffic speed is then compared to a free flow speed of the road link. For instance, when the travel/traffic speed is significantly less than the free flow speed, the road link can be colored red to indicate a congestion. Otherwise, the road link can be colored yellow or green to indicate little or no congestion, respectively.

Figure 2:
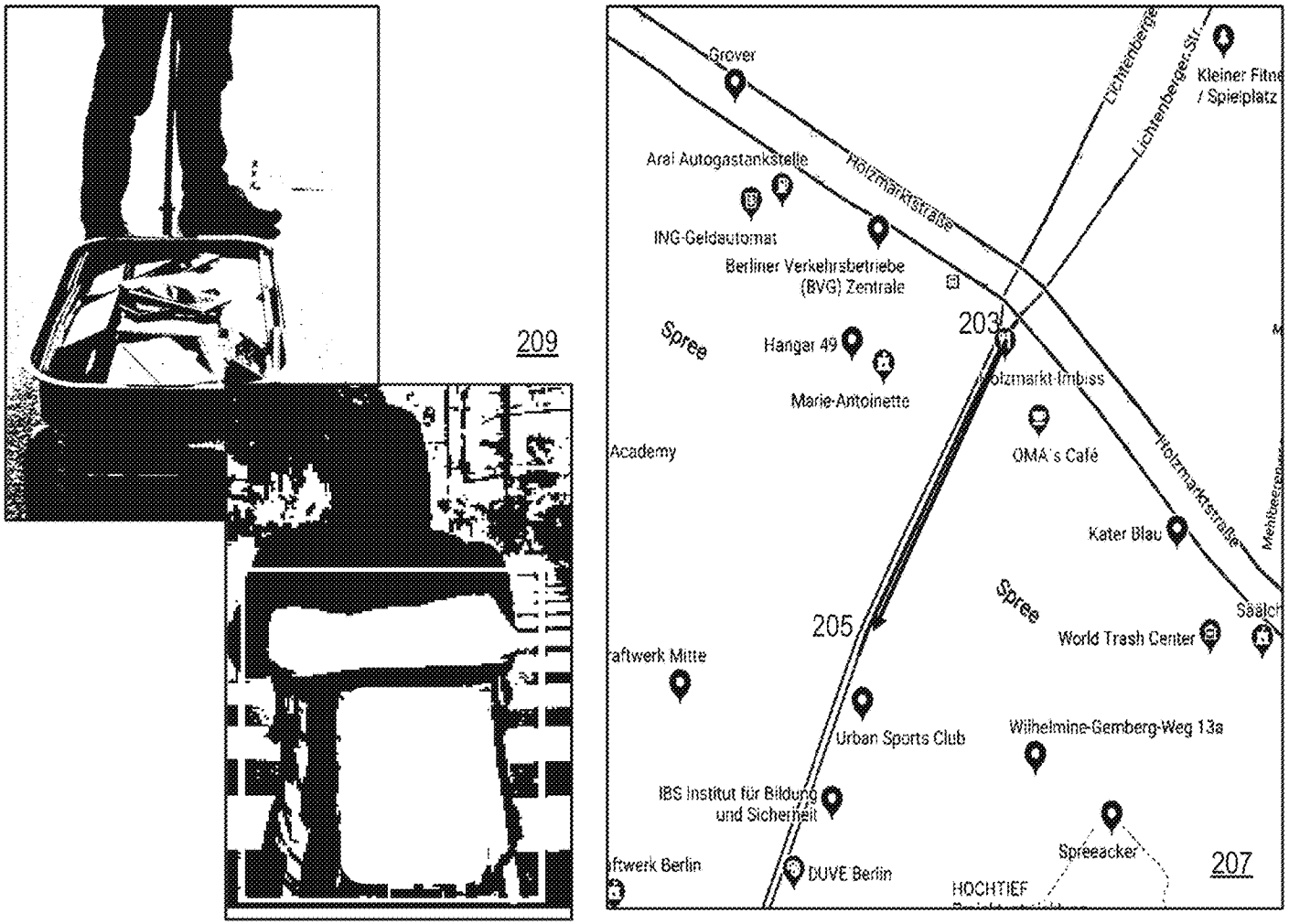
FIG. 2 is a diagram illustrating example misleading traffic events, according to one or more example embodiments.

FIG. 2 is a diagram illustrating example misleading traffic events, according to one or more example embodiments. Referring back to the example of the artist travelling with various smart phones as shown in the image 201, this action effectively tricked the web mapping service's algorithm to report a traffic jam from the starting point 203 to the finish point 205 on the street as shown in the map 207 based on detection of many probe devices (e.g., smart phones) moving slowly on the street, even though the probe devices were carried by the same person walking on the street. Beside the handcart shown in the image 201, the probe devices may be carried and concealed in a backpack as shown in the image 209 to create a similar misleading traffic event (i.e., the deceptive actions need not be as overt as an open handcart to be similarly effective in tricking a web service's mapping algorithm).

To address these challenges, the system 100 introduces a capability to prevent traffic over-reporting via identifying misleading traffic data. For example, the system 100 can collect sensor data from a plurality of user equipment (UE) 101*a*-101*o* (collectively referred to UEs 101) (interchangeable with probe devices hereinafter) to determine if multiple probe devices (e.g., mobile devices, smart phones, etc.) are been carried by the same user (e.g., an individual). Although various embodiments are described with respect to user device probes, it is contemplated that the approach described herein may be used with other types of probes, such as vehicles, drones, etc. By way of example, a delivery or freight truck can carry a plurality of drones traveling slowly on a roadway (for reason other than traffic or road closures) thereby creating a misleading traffic event.

In addition to the kinds of misleading traffic events shown in FIG. 2, the system 100 can identify many categories of misleading traffic events corresponding to UEs 101 carried by different users or items (e.g., a pedestrian, a passenger of a vehicle, an autonomous vehicle, a drone, etc.) moving or located on different portions of a route or street, e.g., a roadway, a bicycle lane, a sidewalk, etc. For instance, a misleading traffic event may involve a bus rider carrying a lot of smart phones (thus misleading vehicular traffic on the roadway), a cyclist carrying a lot of smart phones while riding on a sidewalk (thus misleading foot traffic on the sidewalk), a drone carrying a lot of smart phones while flying over a bicycle lane (thus misleading foot traffic on the bicycle lane), etc.

The sensor data may include probe data and/or other sensor data collected by the UEs 101 via its sensors 103*a*-103*o* (also collectively referred to sensors 103) (e.g., global positioning system (GPS) sensors) and/or applications 105*a*-

105*o* (also collectively referred to applications 105) (e.g., a navigation or mapping application). Some UEs 101 may be carried by a user (e.g., a driver or passenger) driving or riding in a vehicle that may form part of the vehicular traffic for a given area, such that the data associated with the UEs 101 (e.g., probe devices) can be transmitted to a traffic platform 107 via a communication network 109. The traffic platform 107 can include the UEs 101 (e.g., probe devices) in the roadway traffic for reporting. While some other UEs 101 may be carried by a user doing other activities, such as walking, jogging, etc., on the roadway that do not constitute the vehicular traffic, such that these probe devices can be excluded from the roadway traffic by the system 100. To avoid wrongfully including the latter UEs 101 in a traffic report, the system 100 can apply distance and height analysis as shown in FIGS. 3A-3C, multiple clustering as shown in FIG. 4, etc. to identify misleading traffic data as follows.

Figure 3A:
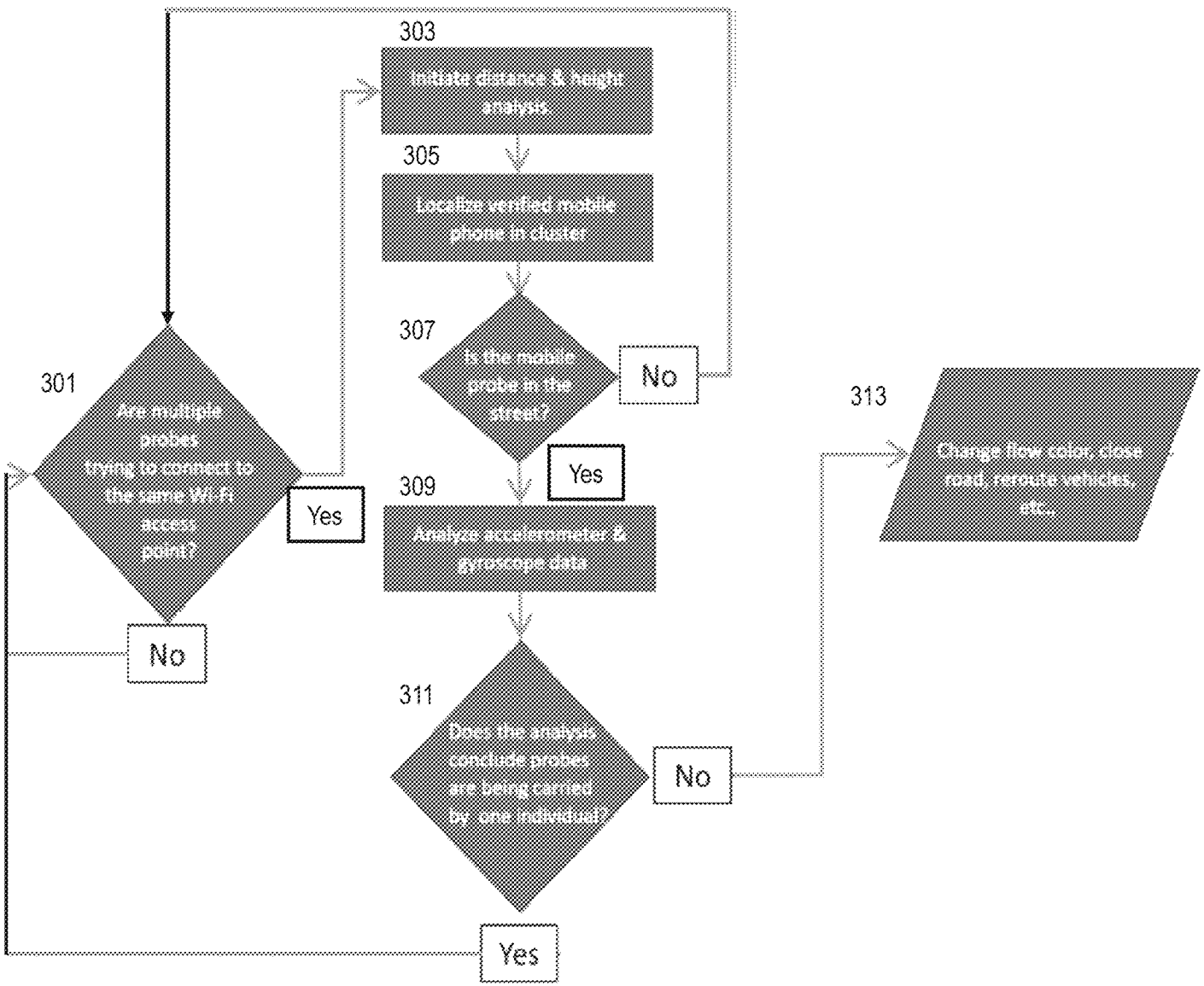
FIG. 3A is a flowchart of an example distance and height analysis process, according to one or more example embodiments.
Figure 3B:
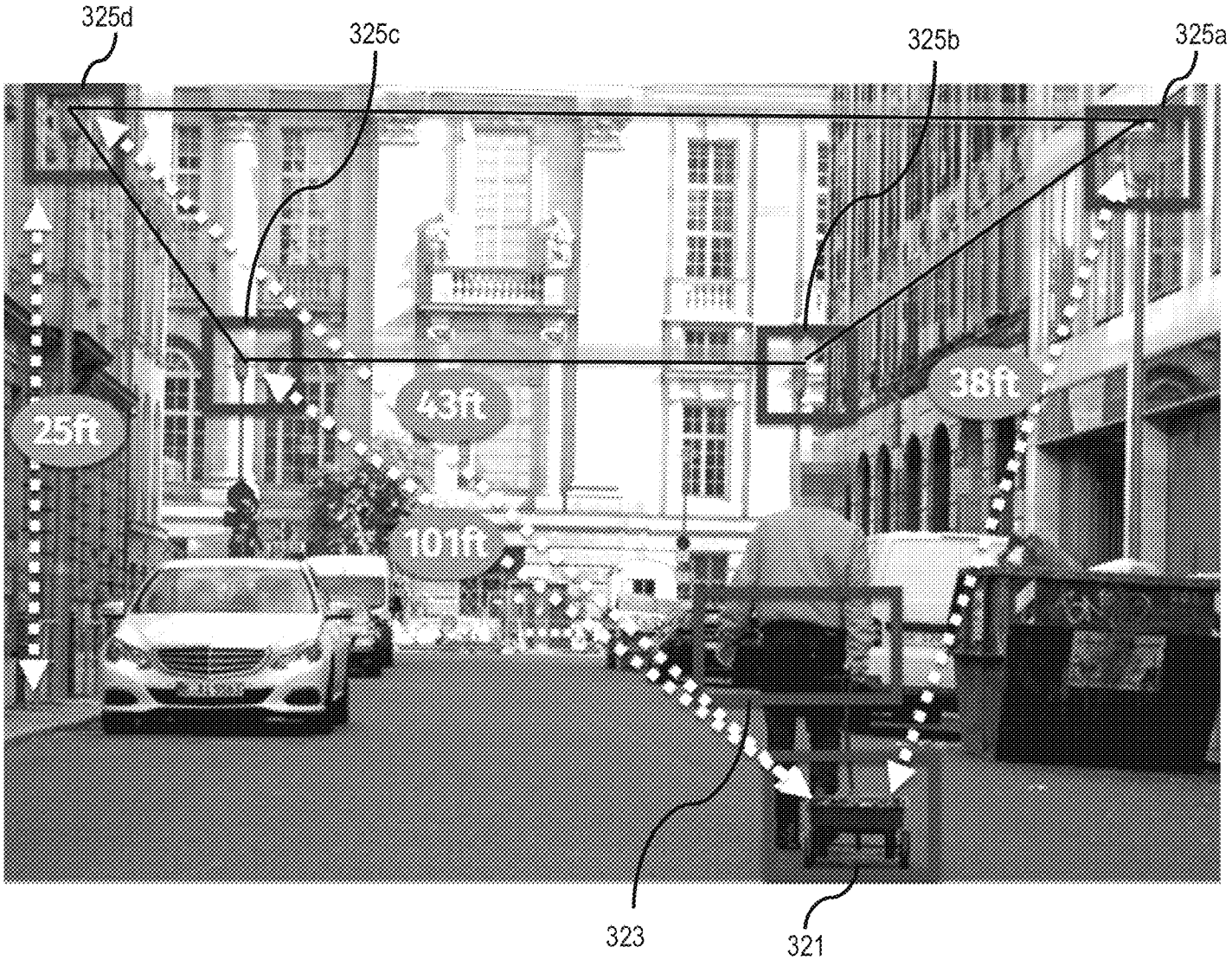
FIGS. 3B and 3C are example diagrams of a distance and height analysis for identifying misleading traffic data, according to one or more example embodiments.
Figure 3C:
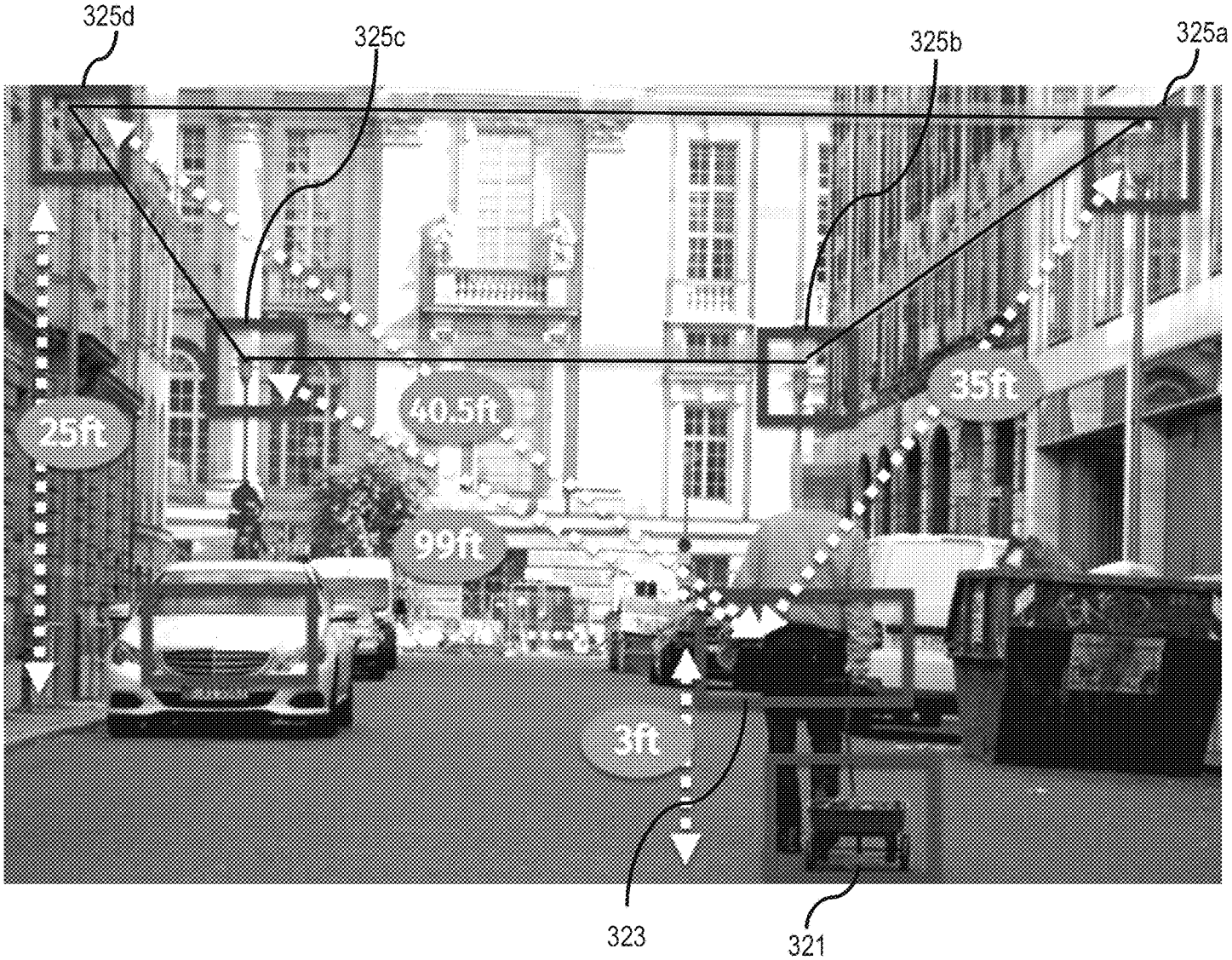
Figure 4:
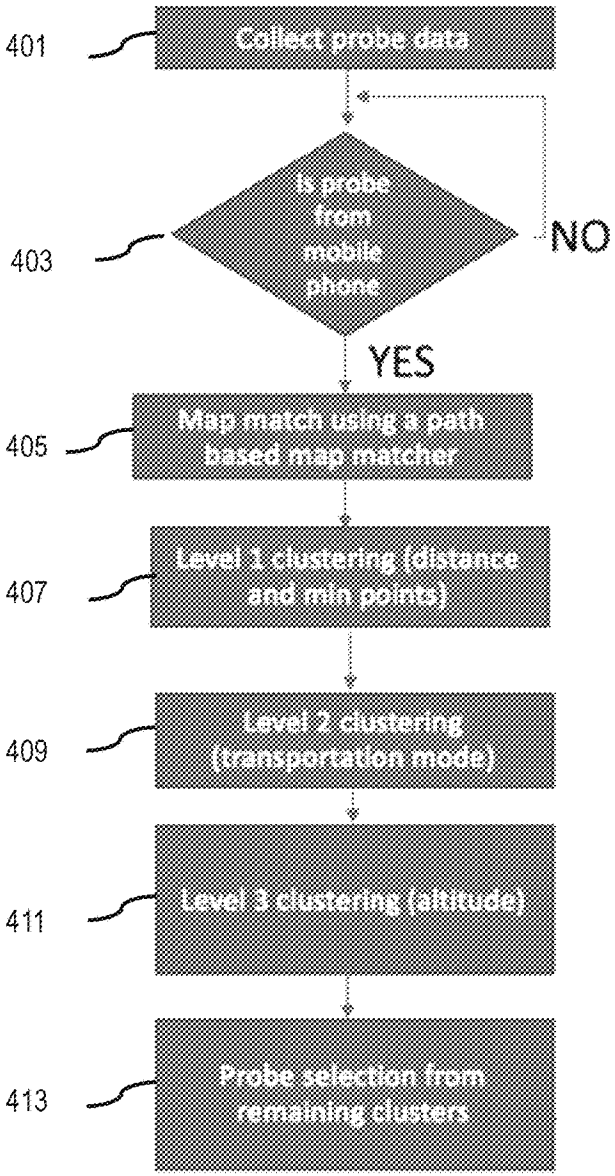
FIG. 4 is a flowchart of a multiple clustering process for identifying misleading traffic data, according to one or more example embodiments.

FIG. 3A is a flowchart of an example distance and height analysis process 300, according to one or more example embodiments. The system 100 can apply a distance and height analysis on the sensor data of the UEs 101 based on their interaction(s) with access points, Bluetooth beacons, etc. to determine whether the UEs 101 are being carried by the same person. In one embodiment, in Step 301, the system 100 can determine whether multiple UEs 101 (e.g., a threshold number of UEs 101) attempt to access/connect to a network or communication access point, such as a WiFi access point, a router, a 5G beacon, etc. associated with communication infrastructure and/or connected road attributes such as light poles, stop signs, fire hydrants, road markings (yellow, white), etc. If the system 100 determines "Yes," then the system 100 can initiate a distance and height analysis on the corresponding UEs 101 in Step 303. Alternatively, if the system 100 determines "No," then the system 100 can continue monitoring such access/connect attempts.

By way of example, a smart city integrates certain Internet of things (IoT) connected to a network using various information and communication technologies. The IOT (e.g., light poles, stop signs, fire hydrants, road markings (yellow, white), etc.) can be embedded with various physical devices/sensors for connecting and exchanging data with other devices/sensors and systems in the network.

In another embodiment, the system 100 can initiate a distance and height analysis on the UEs 101 based on a threshold number of access/connect attempts. For instance, if the system 100 determines during a predetermined time period (e.g., the past 6 months) that the average network connection attempts by UEs 101 on a particular street is 150 attempts every 15 minutes, then if the system 100 determines that the current connection attempts has risen to 250 attempts every 15 minutes, the system 100 can classify this as a unique event and trigger a distance and height analysis in Step 303. Such historic data of access/connect attempts may be stored in or accessible via a database (e.g., the geographic database 111).

The system 100 can determine a height (e.g., a distance off the ground in the z-axis) of a probe device 101 based on heights of a connected infrastructure and/or connected road attributes, such as light poles, stop signs, fire hydrants, road marks (e.g., yellow, white, etc.) etc., retrieved online or offline from a database (e.g., a geographic database 111). With the heights of the infrastructure and/or the road attributes, the system 100 can analyze proximity (e.g., a distance) from the probe device 101 to the WiFi access point of the connected infrastructure, a speed and/or a mode of transport of a probe device 101 moving through the road link and for how long (e.g., a time period). Using known or unknown methods (proprietary or not) and/or processes to analyze the distances and heights in conjunction with the probe device 101's behavior (e.g., speed, mode of transport, signatures, etc.), can assist the system 100 in identifying misleading traffic events. By way of example, when several probe devices 101 on the street share the same distance/height/speed/etc. from the access point, the system 100 can determine with more confidence that these probe devices 101 are been carried by the same person.

FIGS. 3B and 3C are example diagrams of a distance and height analysis performed by the system 100 for identifying misleading traffic data, according to one or more example embodiments. FIG. 3B shows a user dragging a handcart marked with a bounding box 321, the user's back pocket marked with a bounding box 323, and four streetlights marked with bounding boxes 325*a*-325*d*. In FIG. 3B, the location of the probe devices in the handcart can be measured based on positions of one or more of the WiFi access points installed on the light poles (e.g., 25 feet from the ground). By way of example, the handcart is 38 feet from the light in the bounding box 325*a*, 43 feet from the light in the bounding box 325*d*, and 101 feet from the light in the bounding box 325*c*. As such, the system 100 can calculate the height of the handcart as one foot from the ground as well as the handcart's coordinates.

By analogy, in FIG. 3C, the location at least one probe device in the user's back pocket can be measured by the system 100 based on positions of one or more of the WiFi access points installed on the light poles relative to one or more UEs 101 in the user's back pocket. In this example, the user's back pocket is 35 feet from the light in the bounding box 325*a*, 40.5 feet from the light in the bounding box 325*d*, and 99 feet from the light in the bounding box 325*c*. As such, the system 100 can calculate the height of the user's back pocket as 3 feet from the ground as well as the coordinates of the user's back pocket.

In one instance, the system 100 can use the determined distance/height data to locate/localize a cluster/group of probe device(s) 101's street position(s) in Step 305 to calculate speed and travel time period data relative to the probe device(s) 101. With the speed(s) and time period data of the probe device(s) 101, the system 100 can further locate/localize the probe device(s) 101's position(s) as to whether on a roadway, sidewalk, bicycle lane, etc. in Step 307. When the system 100 determines that probe device(s) 101 is/are on the street/roadway, the system 100 will move forward to Step 309 to identify misleading traffic data (e.g., misleading probe device counts of the cluster/group in the roadway traffic). When the system 100 determines that the probe device(s) 100 is/are not in the street (e.g., on the sidewalk), these devices were not included by the system 100 in the roadway vehicular traffic anyway, so they do not need to be excluded from the respective roadway vehicular traffic report. As such, the system 100 will not proceed further to prevent traffic over-reporting but continues monitoring such access/connect attempts by the probe devices 101, as described with respect to Step 301.

In Step 309, the system 100 can analyze other sensor data of the UEs 101 (e.g., probe devices), such as gyroscope data, accelerometer data, etc., to further determine whether some of the probe devices are carried by the same person. For instance, the gyroscope data can provide angles of rotation of probe devices, and the accelerometer data can provide vibrations of the probe devices. By way of example, in addition to the same distance and height from the access point, when several probe devices on the street have similar angles of rotation (e.g., gyroscope signature) and/or similar vibration signatures such as (e.g., acceleration in the x, y, and z axis captured by the accelerometer), etc., the system 100 can determine with greater confidence that these probe devices are carried by the same person. In Step 311, the system 100 can conclude based on the foregoing steps that these probe devices 101 are carried by the same person. In the instances where the system 100 concludes "Yes," the system 100 can adjust/reduce the number of the group of probe devices (e.g., suppressed into one) to prevent over-reporting traffic events and can continue monitoring probe device access/connect attempts, as described with respect to Step 301. In the instances where the system 100 concludes "No," the system 100 can report the number of the group of probe devices as a change in traffic flow color, as a closed road, as rerouted vehicles, etc., based on the report in Step 313. Meanwhile, the system 100 can continue monitoring probe device access/connect attempts.

In another embodiment, the system 100 can perform a reverse height and distance analysis (HDA) in an offline situation. For example, when the system 100 determines that probe devices 101 are offline (e.g., disconnected from a cellular network), the system 100 can perform a reverse HDA using real-time data from the connected infrastructure using offline map data (e.g., stored in or accessible via the geographic database 111). A reverse HDA may be ideal in situations where the probe devices are disconnected from a cellular network (e.g., 5G network) yet connected to a short-range wireless communication network (e.g., WiFi). In this case, radio signal strength is not a major factor because height and distance information can be included in the offline map data even when the probe devices 101 are disconnected, and/or even when the probe devices are using offline maps.

FIG. 4 is a flowchart of a multiple clustering process 400 for identifying misleading traffic data, according to one or more example embodiments. In one embodiment, in Step 401, the system 100 can collect probe data of a plurality of probe devices 101 and/or retrieve the probe data from a database (e.g., the probe database 113). In one instance, the real-time probe data may be reported as probe points, which are individual data records collected at a point in time that records telemetry data for that point in time. A probe point can include attributes such as: (1) probe ID, (2) longitude, (3) latitude, (4) altitude, (5) heading, (6) speed, and (7) time.

In Step 403, the system 100 can determine whether the probe data is associated with a stand-alone probe device 101 (e.g., a smart phone) or a probe device on-board or built-in a vehicle (e.g., an embedded navigation system). When the probe data is associated with a stand-alone probe device 101, the system 100 can proceed to Step 405. Alternatively, when the probe data is associated with probe device 101 on-board or built-in a vehicle, the system 100 can suppress/prune the probe data, weighting the number of probe devices to a smaller number, or sampling the cluster of probe devices very infrequently, and return to Step 401 to process subsequently collected and/or retrieved probe data.

In Step 405, the system 100 can map-match the probe data of the stand-alone probe devices (e.g., UEs 101) to road links using location and heading information of the probe data, and/or a path-based map matcher. The road links can be retrieved online or offline from a database (e.g., the geographic database 111).

After map matching, probe clusters can be identified by the system 100, for example, via unsupervised machine learning (e.g., density-based spatial clustering of applications with noise (DBSCAN)) based on distance and time point data of the probe points in Step 407. The system 100 can infer from clustered probe data that the respective probes (e.g., UEs 101) are carried by the same person. By way of example, the DBSCAN algorithm can cluster the probe data where probes are within a distance threshold (e.g., 10 m). A cluster is formed if there are at least two probes located within a distance threshold, i.e., the first layer of clustering. For instance, the distance threshold and/or a clustering radius can be configurable to account for location sensing uncertainty, such as due to the GPS errors and/or positioning precision and multipath phenomena.

In Step 409, the system 100 can carry out a second layer of clustering, where probes (e.g., UEs 101) of the same distance cluster are analyzed with respect to a mode of transport (e.g., bicycle, bus, car, walking, etc.) based on probe point data and/or transportation network information (e.g., stored in or accessible via the geographic data 111, the probe database 113, or a combination thereof). Thus, for each distance cluster, subclusters of the same mode of transport can be formed using a transportation mode detection algorithm (e.g., a Bayesian net, a decision tree, a random forest, a Naïve Bayesian, a multilayer perceptron, etc.). In one embodiment, the system 100 can assume that probes clustered into different modes of transport should be carried by different people. Meanwhile, there is a high chance that probes clustered into the same mode of transport are carried by the same person. Thus, Step 409 helps to further assure that the probes clustered into the same mode of transport are carried by the same person.

In Step 411, the system 100 can carry out a third layer of clustering, where probes (e.g., UEs 101) of the same distance and mode of transport cluster are further analyzed based on altitude data (the z-axis). It is possible to have probes of the same mode of transport but at different z levels, such as in instances involving users or vehicles on or under an overpass. Step 411 helps to further assure that the probes clustered into the same altitude are carried by the same person. In one instance, after the system 100 performs the three layers/levels of clustering, the probe IDs of each remaining cluster are saved, and then passed to subsequent processing (e.g., adjusted/suppressed from traffic reporting).

In one embodiment, the system 100 can add a confidence factor to the output of Step 411, as an additional attribute to the three-time-clustered probes (e.g., UEs 101). This confidence factor can indicate a certainty level of the output from the 3-level clustering of the probes and this confidence factor can range between 0 and 1, for example. When the confidence factor is closer to one, the system 100 is highly confident that a cluster of probe devices 101 are carried by the same person instead of by different individuals, each with one probe 101. As a result, the system 100 can suppress the probes and/or manually verify the probes as carried by the same person.

When the confidence factor is closer to 0, the system 100 is unlikely to infer with confidence that the probes from a cluster are carried by the same person. As a result, the system 100 will not suppress/prune the probes and use them to report traffic closure. By analogy, the confidence factor/level can be applied to the distance and height analysis of FIG. 3A to determine these probe clusters.

Given the clusters from Step 411, only a single probe 101 is selected, for example, by the system 100 as the representative for its cluster and included in a traffic report in Step 413. By way of example, the system 100 can select the last probe reported from the cluster as the one and only probe included in the traffic report on behalf of the probe cluster, since the probes are carried by the same person and the last probe reported is likely the most up to date in terms of location, speed, etc.

In other embodiments, the system 100 can apply the multiple clustering process: the distance-time clustering, mode of transport clustering, altitude clustering, signature clustering, etc. in different orders from the order described above with respect to the process 400. In other embodiments, the system 100 can apply one or more of the multiple clustering processes to balance between confidence and computation cost (e.g., time, resources, etc.). For example, the more kinds of multiple clustering processes applied by the system 100, the higher the confidence factor, but also increasing computation costs.

In another embodiment, the system 100 can from time to time, periodically (e.g., every thirty minutes), and/or randomly carry out the three levels of clustering, i.e., time domain aggregation, to further assure (e.g., increasing the confidence factor) that the probes (e.g., UEs 101) are carried by the same person.

In yet other embodiment, the system 100 can cross-check results from the distance and height analysis as shown in FIGS. 3A-3C with the results determined from multiple clustering processes as described in FIG. 4. This also gives the system 100 confidence that the probe devices 101 are carried by the same person.

In yet other embodiment, the system 100 can distinguish legitimate clusters from false positive clusters. By way of example, some events can generate false positive clusters since many people in a close vicinity that send probe data may be wrongly detected by the system 100 as a cluster of probe devices (e.g., UEs 101) carried by one person. For instance, using data of an event start time, end time, location, the system 100 can identify and suppress potential false positive clusters. As another instance, the system 100 can determine the confidence level after step 411 based on probe penetration. For example, when the system 100 determines that many more probes are observed on a functional class (FC) 5 roadway (e.g., a major collector roadway) than normally observed, the confidence factor thereof can be higher than on a road where the historical density is always high (i.e., the system 100 can detect a relatively significant change of probe density).

After the adjustment, the system 100 can include only valid probe data in traffic report(s) and publish the traffic report(s) to the vehicles and/or the UEs 101 to support location-based services, such as navigation, autonomous driving, etc. By way of examples, the traffic report(s) can be used by an advanced driver-assistance system to set/adjust operational settings of vehicles travelling on the street of interest to reduce a speed, change to a safer lane, braking, etc., so as to avoid traffic/blockage, shorten estimated time of arrival (ETA), mitigate potential accidents, etc.

As another example, the system 100 can transmit the valid probe data to update a digital map and/or a database (e.g., the geographic database 111) to support location-based services, such as vehicle navigation services, vehicle fleet management services, ride-sharing services, vehicle assistance/repair services, vehicle insurance companies, user health insurance companies, etc. to manage the vehicles, to adjust insurance rates, etc., depending on the valid probe data.

In another embodiment, the system 100 can validate the probe data using cross-checking and/or feedback loops based on, for example, user/vehicle behavior(s) (e.g., from sensor data) and/or feedback data (e.g., from survey data). For instance, misleading probe data can be cross-checked by a machine learning model (e.g., developed by a machine learning system 115 of the traffic platform 107) that can detect from an aerial image (e.g., taken by a drone, the satellites 123, etc.) that the same person is walking with a plurality of probe devices on a road link. As another instance, the system 100 can crowd-source data from the users and/or autonomous vehicles that observe the same person is walking with a plurality of probe devices on a road link.

In summary, the system 100 can automatically process probe data and/or sensor data associated with probe devices in real-time or substantially real-time, resolve the misleading traffic event issues using distance and height analysis, multiple clustering, etc. as discussed, and adjust the probe device counts accordingly to prevent over-reporting, thus improving the accuracy of digital map data which would otherwise require manual efforts.

It is noted that although the various embodiments are discussed with respect to probe devices 101 (e.g., a mobile device, a smartphone, etc.) carried by the same person walking on a roadway, it is contemplated that the embodiments are also applicable to probe devices carried by other single entity such as a vehicle, or other means that can convey multiple probe devices. For example, a vehicle (e.g., a bicycle, a bus, an airplane, a subway, a train, etc.) can be used to carry multiple phones (e.g., probe devices) to influence traffic reporting algorithms, or even just multiple people carrying separate phones traveling in or on one vehicle in traffic (with each phone separately reporting congestion from the vehicle). The traffic report can count the vehicle as one probe device 101 instead of the number of the probe devices 101 carried by the vehicle.

With the adjusted traffic report, the system 100 can correctly render the color of the traffic flow on a digital map (e.g., green, red, yellow, black), correctly closing a road (e.g., highway, arterial roadway, etc.) if necessary, correctly recommending a new route for a user, correctly rerouting users, public safety officials/first responders, etc.

Figure 5:
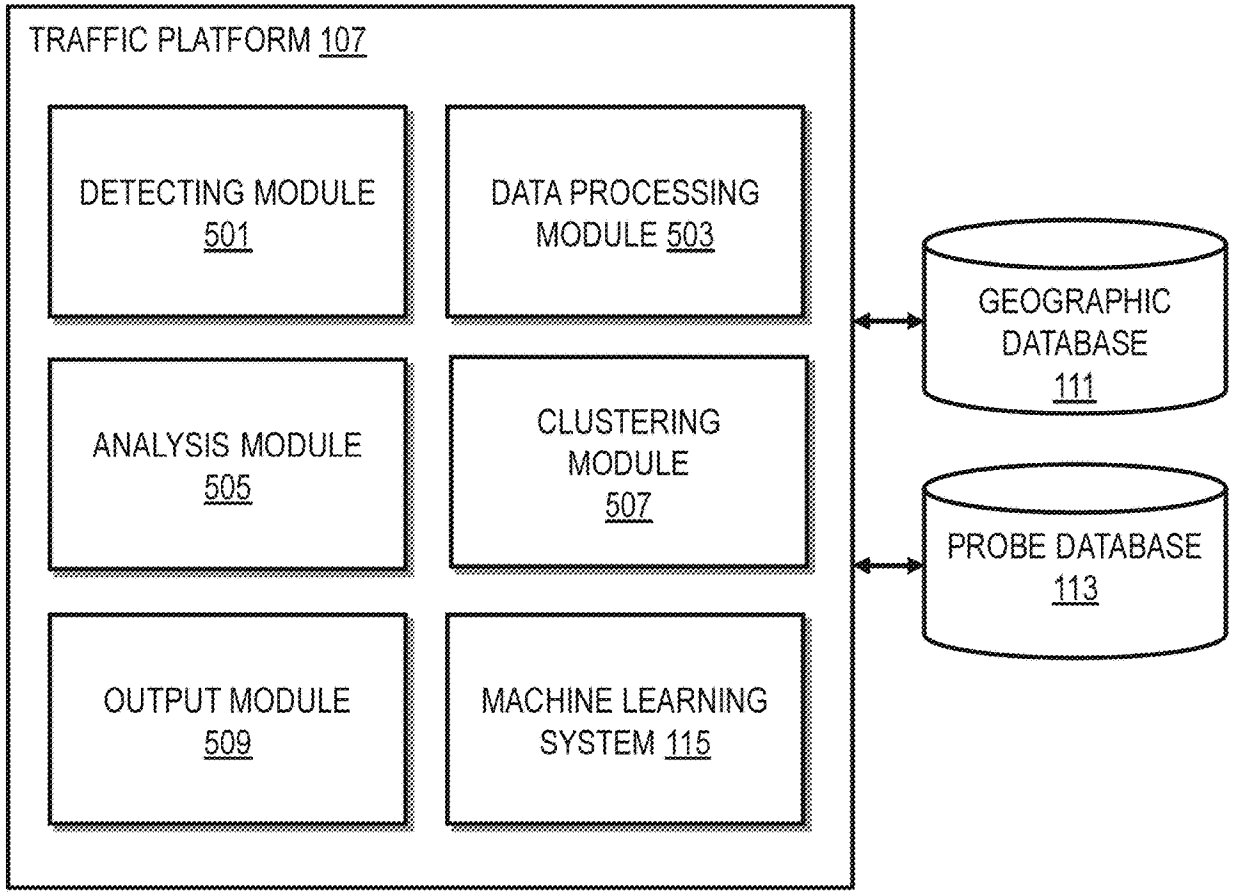
FIG. 5 is a diagram of the components of the traffic platform, according to one or more example embodiments.

FIG. 5 is a diagram of the components of the traffic platform 107, according to one or more example embodiments. In one embodiment, the traffic platform 107 includes one or more components for preventing traffic over-reporting via identifying misleading traffic data according to the various embodiments described herein. As shown in FIG. 5, the traffic platform 107 includes a detecting module 501, a data processing module 503, an analysis module 505, a clustering module 507, an output module 509, and the machine learning system 115 and has connectivity to the geographic database 111 and the probe database 113. The above presented modules and components of the traffic platform 107 can be implemented in hardware, firmware, software, or a combination thereof. The above presented modules and components of the traffic platform 107 can be implemented in hardware, firmware, software, or a combination thereof. It is contemplated that the functions of these components may be combined or performed by other components of equivalent functionality. Though depicted as a separate entity in FIG. 1, it is contemplated that the traffic platform 107 may be implemented as a module of any of the components of the system 100 (e.g., a component of the vehicles and/or the UEs 101). In another embodiment, the traffic platform 107 and/or one or more of the modules 501-509 may be implemented as a cloud-based service, local service, native application, or combination thereof. The functions of the traffic platform 107, the machine learning system 115, and/or the modules 501-509 are discussed with respect to FIGS. 6-9 below.

Figure 6:
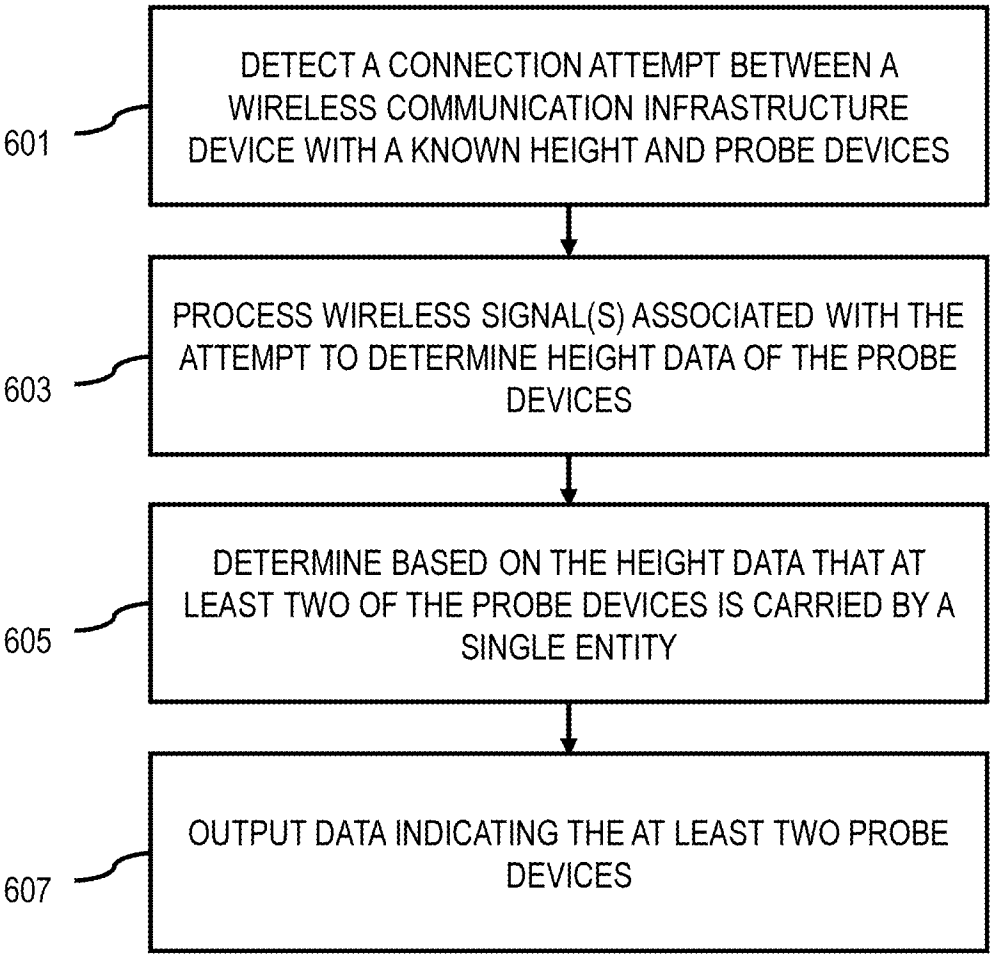
FIG. 6 is a flowchart of a process for preventing traffic over-reporting via identifying misleading traffic data, according to one or more example embodiments.
Figure 12:
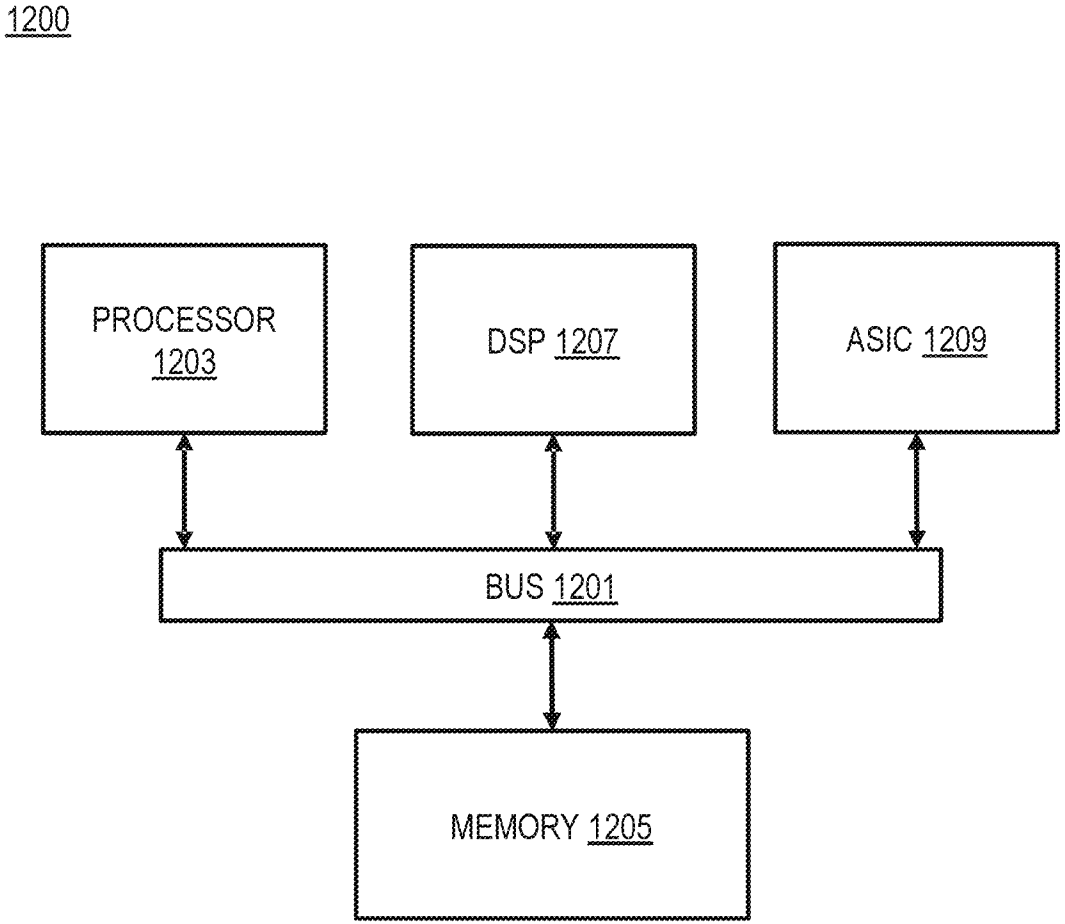
FIG. 12 is a diagram of a chip set that can be used to implement an embodiment of the invention, according to one or more example embodiments.

FIG. 6 is a flowchart of a process 600 for preventing traffic over-reporting via identifying misleading traffic data, according to one or more example embodiments. In various embodiments, the traffic platform 107, the machine learning system 115, and/or any of the modules 501-509 may perform one or more portions of the process 600 and may be implemented in, for instance, a chip set including a processor and a memory as shown in FIG. 12. As such, the traffic platform 107 and/or the modules 501-509 can provide means for accomplishing various parts of the process 600, as well as means for accomplishing embodiments of other processes described herein in conjunction with other components of the system 100. The steps of the process 600 can be performed by any feasible entity, such as the traffic platform 107, the modules 501-509, the machine learning system 115, etc. Although the process 600 is illustrated and described as a sequence of steps, it is contemplated that various embodiments of the process 600 may be performed in any order or combination and need not include all the illustrated steps.

In one embodiment, in step 601, the detecting module 501 can detect a connection attempt between a wireless communication infrastructure device (e.g., in a smart city) and a plurality of probe devices (e.g., UEs 101 such as a mobile device, a smartphone, etc.). By way of examples, the wireless communication infrastructure device can include a wireless network access point, a Bluetooth beacon, a 5G beacon, a fiber wire, a cellular tower, or a combination thereof. In one embodiment, the wireless communication infrastructure device (e.g., a streetlight in FIG. 3B indexed in map data) is associated with a known height (e.g., 25 feet). The location data of the wireless communication infrastructure device can be retrieved from a database (e.g., the geographic database 111, a urban city planning database that indexes Bluetooth, Wi-Fi, placement of 5G infrastructure, etc.)

In one embodiment, in step 603, the data processing module 503 can process one or more wireless signals (e.g., radio signals) associated with the connection attempt (e.g., using radio signal strength) to determine height data (e.g., one foot from the ground) of the plurality of probe devices 101 (e.g., smart phones in a handcart in FIG. 3B).

By way of example, the data processing module 503 can retrieve online or offline location data of the wireless communication infrastructure device indexed in map data (e.g., stored in or accessible via the geographic database 111), and the height data of the plurality of probe devices 101 is further determined based on the location data of the wireless communication infrastructure device (e.g., stored in or accessible via the geographic database 111).

In another embodiment, the data processing module 503 can process the one or more wireless signals to determine distance data (e.g., real-time distances from the streetlights in FIG. 3B) and speed data of the corresponding plurality of probe devices 101, and the data indicating the at least two of the plurality of probe devices is further based on the distance data and the speed data. For instance, a shared or similar speed suggests that the at least two devices is carried by a single entity.

In one embodiment, in step 605, the analysis module 505 can determine based on the height data that at least two of the plurality of probe devices are carried by a single entity (e.g., a lot of smart phones in the handcart dragged by the person in FIG. 3B). By way of examples, such single entity can be a person, vehicle, drone, etc. that can carry multiple probes and/or probe devices.

In another embodiment, the analysis module 505 can determine a location per probe device as located on a roadway portion, a bicycle lane portion, or a sidewalk portion of the road segment (e.g., using map data of roadway/sidewalk/bicycle land width, etc.), and further determine a mode of transport per probe device based on the location, the height data, the distance data, the speed data, or a combination thereof. By way of example, the mode of transport includes walking, car, bus, truck, or bicycle. In one instance, the map data of roadway/sidewalk/bicycle land width, etc. may be stored in or accessible via the geographic database 111.

In one embodiment, the clustering module 507 can cluster the plurality of probe devices (e.g., UEs 101) per mode of transport, and the data indicating the at least two of the plurality of probe devices is further based on the mode of transport, the clustering, or a combination thereof.

In another embodiment, the data processing module 503 can process sensor data (e.g., sensor data 103 such as gyroscope data, accelerometer data, etc.) from the plurality of probe devices (e.g., UEs 101) to determine one or more signatures (e.g., synchronized movements based on same distance, height, angles of rotation from the access point (gyroscope), speed (accelerometer), vibration, etc.) shared by a portion of the plurality of probe devices (which may fully or partially overlap with the at least two of the plurality of probe devices). The data indicating the at least two of the plurality of probe devices can be further based on the one or more signatures. For example, the one or more signatures can include a speed, a vibration, a noise, a distance, a height, an angle of rotation from the wireless communication infrastructure device, or a combination thereof of the portion of the plurality of probe devices. By way of example, a unique noise and/or vibration signature can be generated from the probe devices touching one another and/or from the movement or cadence of the person (e.g., steps per minute).

It is more likely that the at least two probe devices share the one or more signatures since they are carried by the same entity, such that the portion of the probe devices fully overlap with the at least two probe devices. However, the depending on how the probe devices were stacked on one another, some of the probe devices carried by the same entity may not share the one or more signatures (e.g., noise, vibration, etc.). In this case, the portion of the probe devices partially overlap with the at least two probe devices.

In one embodiment, in step 607, the output module 509 can provide data indicating the at least two of the plurality of probe devices as an output. For instance, the system can suppress the output from a traffic report to prevent over-reporting).

In one embodiment, the output module 509 can adjust one or more traffic events (e.g., traffic analysis of vehicular traffic on a road segment), one or more map events, or a combination thereof determined from probe data collected from the plurality of probe devices (e.g., UEs 101) based on the data indicating the at least two of the plurality of probe devices. By way of example, the adjustment associates the one or more traffic events, one or more map events, or a combination thereof as with one instead of the at least two of the plurality of probe devices (thereby preventing over-reporting). For instance, the adjust reduces the number of applicable probes, which in turn reduces the amount of traffic, etc.

In one embodiment, the output module 509 can integrate blockchain technology to compare and analyze a probe device's real-time z-axis (vertical) position above the ground and its x, y-axis (horizontal) position against real-time and historical data (blockchain), to generate/create an algorithm that can determine the actual state of the road link as open, closed, etc.

By way of example, the system 100 can reject a request to close the road due to the misleading traffic events determined by . . . . Looking at this from a traffic quality/traffic incidents management perspective, the system 100 can alert a traffic incidents team to authenticate/verify the road closure. A weighted traffic incident module may also be integrated in this process depending on the road's functional class (FC) designation (e.g., FC1, FC2, FC3, etc.).

Instead of the distance and height analysis based on a wireless communication infrastructure device of FIG. 6, the system 100 can apply just a z-level clustering on probe data to identify misleading traffic data. In one embodiment, the data processing module 503 can map-match probe data associated with a plurality of probe devices (e.g., UEs 101) to a road segment. The clustering module 507 can then perform a z-axis clustering on the probe data. The analysis module 505 then can determine based on the z-axis clustered probe data that at least two of the plurality of probe devices are carried by a single entity (e.g., a person, a vehicle, and/or anything that can carry multiple UEs 101 such as a mobile device, a smartphone, etc.). The output module 509 then can provide data indicating the at least two of the plurality of probe devices as an output (e.g., for adjusting a traffic report, presenting the adjusted traffic report, etc.).

In one embodiment, the output module 509 can adjust one or more traffic events, one or more map events, or a combination thereof determined from the probe data based on the data indicating the at least two of the plurality of probe devices obtained just based on the z-level clustering on the probe data. By way of example, the adjustment associates the one or more traffic events, one or more map events, or a combination thereof as with one instead of the at least two of the plurality of probe devices. In another embodiment, the clustering module 507 can perform a distance clustering and a speed clustering on the z-axis clustered probe data, and the data indicating the at least two of the plurality of probe devices is further based on the distance and speed clustered probe data.

In another embodiment, the clustering module 507 can perform a mode of transport (MOT) clustering on the distance and speed clustered probe data, and the data indicating the at least two of the plurality of probe devices is further based on the MOT-clustered probe data.

In one embodiment, the analysis module 505 can determine a confidence factor for the data indicating the at least two of the plurality of probe devices based on the distance clustering, the z-axis clustering, the speed clustering, the MOT clustering, or a combination thereof. The output can include the confidence factor.

In other embodiments, the system 100 can apply the distance and height analysis, a mode of transport clustering on probe data, the street portion clustering, the signature clustering, etc. after the z-level clustering on probe data, to confirm/verify the misleading traffic data identified via the z-level clustering.

Instead of the distance and height analysis and the z-level clustering, the system 100 can apply just a mode of transport clustering on probe data to identify misleading traffic data. In one embodiment, the analysis module 505 can determine a mode of transport per probe device for a plurality of probe devices based on one or more broadcasting signals, height data or a combination thereof associated with the plurality of probe devices, and further determine based on the mode of transport that at least two of the plurality of probe devices are carried by a single entity. The output module 509 then can provide data indicating the at least two of the plurality of probe devices as an output.

By way of example, the analysis module 505 can determine the mode of transport via an identifier in the one or more broadcasting signals, such as a mode of transport data flag in a traffic broadcasting signal. As another example, the detecting module 501 can detect a connection attempt between a wireless communication infrastructure device (e.g., wireless network access point, a Bluetooth beacon, a 5G beacon, a fiber wire, a cellular tower, etc.) and the plurality of probe devices (e.g., UEs 101). For instance, the wireless communication infrastructure device is associated with a known height. The data processing module 503 can then process one or more wireless signals associated with the connection attempt to determine the height data of the plurality of probe devices, and use the height data to determine the mode of transport.

In one embodiment, the output module 509 can adjust one or more traffic events, one or more map events, or a combination thereof determined from probe data collected from the plurality of probe devices based on the data indicating the at least two of the plurality of probe devices obtained just based on the mode of transport clustering on the probe data.

In one embodiment, the data processing module 503 can process the one or more wireless signals to determine speed data of the plurality of probe devices, and the data indicating the at least two of the plurality of probe devices is further based on the speed data.

In other embodiments, the system 100 can apply the distance and height analysis, a z-level clustering on probe data, the street portion clustering, the signature clustering, etc. after the mode of transport clustering on probe data, to confirm/verify the misleading traffic data identified via the mode of transport clustering.

Figure 7:
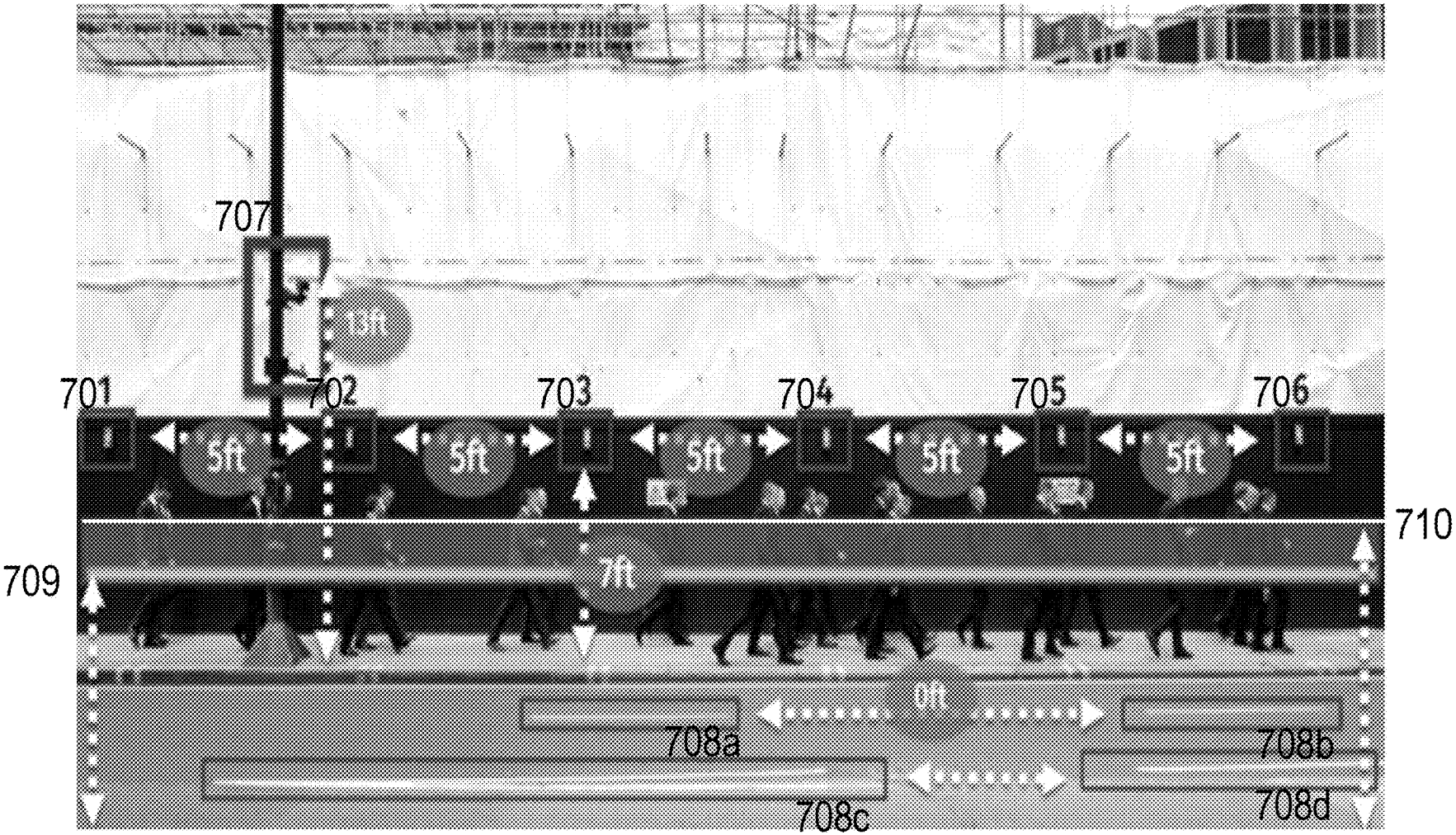
FIG. 7 is a diagram of a distance and height analysis in connection with pedestrians on a sidewalk for identifying misleading traffic data, according to one or more example embodiments.

FIG. 7 is a diagram of a distance and height analysis of pedestrians on a sidewalk for identifying misleading traffic data, according to one or more example embodiments. By way of example, the system 100 can determine that the people are on a sidewalk in a downtown area/business district with construction taking place, are heading to work, and that time of day is between Sam-9 am. Due to the construction, additional wireless communication infrastructure devices (e.g., a 5G beacon, a surveillance camera, etc.) are installed on site.

In this embodiment, the system 100 can integrate demographic data into the above-discussed embodiments. By way of example, the system 100 can initiate a data scan (e.g., of information or data stored in accessible via the geographic database 111) to determine the average heights of the people who live/work/visit this street during this time (8 am-9 am) at a given frequency threshold (e.g., every weekday).

By establishing the average height of the people who frequent this street, the system 100 can gather data on the general positions or manner that probe devices (e.g., UEs 101 such as smart phones) are carried, e.g., pants pocket, belt clip, in-hand, etc. The system 100 can query for additional context data such as an average number of smart phones using navigation maps on the street (e.g., stored in or accessible via the geographic database 111), at this time of day (e.g., between 8 am-9 am), and by what kinds of people (e.g., demographics like age, sex, height, stride, education, work, nationality, religion, ethnicity, etc.). For instance, people of certain demographics can hold or use their smart phones at different heights.

FIG. 7 shows several 5G beacons marked with bounding boxes 701-706 (e.g., 5-feet apart and 7-feet from the ground), a surveillance camera marked with a bounding box 707 (e.g., (13-feet from the ground), and white road marks marked with bounding boxes 708*a*-708*d* in a section of the street adjacent to a construction area. In one embodiment, the system 100 can determine and/or measure the positions of the probe devices carried by the pedestrians on the sidewalk (including distance, height, etc.) based on the positions of the one or more of the 5G beacons 701-706 and the surveillance camera 707 based on the distance and height analysis, the multiple clustering, etc. described with respect to various embodiments herein to identify misleading traffic event(s). By way of example, when the system 100 can associate each probe with each person and/or the system 100 can compare the current number of probes with the historical number of probes to determine that there is just traffic and no missing leading traffic event. However, when the system 100 cannot make such correlation or comparison, the system 100 can determine a misleading traffic event, unintentional or intentional (like with the artists or a bad actor).

In one embodiment, the system 100 can using blockchain technology and/or historical context data (e.g., stored in or accessible via the geographic database 111) in conjunction with the distance and height analysis, the multiple clustering, etc., to create an algorithm and/or a machine learning model (e.g., for use with the machine learning system 115) that can decide whether a misleading traffic event occurs, whether to close a road (for heavy traffic, etc.), whether to recommend a road closure, etc.

In one embodiment, the system 100 can carry out a probe distance and height analysis (e.g., the process 600) in conjunction with the demographic data of the people in FIG. 7 to determine if one or more of the people are carrying multiple UEs 101 (e.g., mobile probes) to manipulate a web traffic routing algorithm and if so, the system 100 can adjust the corresponding traffic reporting accordingly. For instance, the system 100 can calculate a baseline height 709 representing an average height (e.g., 3 feet) of idle probe devices for the demographic of the pedestrians on the sidewalk during 8 am to 9 am. In addition, the system 100 can calculate a baseline height 710 representing an average height (e.g., 4.5 feet) of probe devices in use by the demographic of the pedestrians on the sidewalk during 8 am to 9 am. As such, the system 100 can compare heights of the probe devices against the baseline heights 709 and 710 to identify misleading traffic event(s) and adjust a foot traffic report accordingly. For example, when the system 100 determines UEs 101 outside of the area between the baselines heights 709 and 710 by a threshold distance, the system 100 can infer that the UEs 101 associated with one individual outside of the baselines as misleading and should be suppressed.

In one embodiment, the machine learning system 115 can build and train a misleading traffic event machine learning model to prevent traffic over-reporting via identifying misleading traffic data. For instance, the misleading traffic event machine learning model can extract misleading traffic event classification features and map the features to misleading traffic event categories such as the categories in a matrix/table in the FIG. 8.

In addition to the demographic data (e.g., of the pedestrians in FIG. 7) (e.g., stored in or accessible via the geographic database 111), the system 100 can integrate other context data as described with respect to FIG. 8 into the above-discussed embodiments for identifying misleading traffic data. FIG. 8 is a diagram of an example machine learning data matrix/table 800, according to one or more example embodiments. In one embodiment, the matrix/table 800 can further include map feature(s) 801 (e.g., speed limit, signs (e.g., light poles), map features associated with wireless communication infrastructure devices, etc.); mode of transport feature(s) 803 (e.g., make, model, sensors, etc.); mode of transport operation setting(s) 805 (e.g., speed, sensor operations, autonomous vehicle (AV)/manual mode, etc.); user features 807 (e.g., age, height, stride, mobility patterns, etc.); and environmental features 809 (e.g., weather, events, traffic, traffic light status, construction status, visibility, etc.), etc., in addition to misleading traffic event categories 811 (e.g., different carrying entities such as a pedestrian, a vehicle passenger, an autonomous vehicle, a drone, etc. on different portions of the street, e.g., a roadway, a bicycle lane, or a sidewalk, etc.). For instance, a misleading traffic event category can be derived from map data, sensor data, probe data, context data 801-809, etc. using a machine learning model independently or in conjunction with the distance and height analysis, the multiple clustering, etc. to identify a misleading traffic event.

By way of example, the matrix/table 800 can list relationships among context features and training data. For instance, notation 〖mf〗^i can indicate the ith set of map features, 〖vf〗^i can indicate the ith set of mode of transport features, 〖sf〗^i can indicate the ith set of mode of transport operation settings, 〖pf〗^i can indicate the ith set of user features, 〖ef〗^i can indicate the ith set of environmental features, etc.

In one embodiment, the training data can include ground truth data taken from historical misleading traffic event data (e.g., stored in or accessible via the geographic database 111). For instance, in a data mining process, context features are mapped to ground truth map objects/features to form a training instance. A plurality of training instances can form the training data for the misleading traffic event machine learning model using one or more machine learning algorithms, such as random forest, decision trees, etc. For instance, the training data can be split into a training set and a test set, e.g., at a ratio of 70%:30%. After evaluating several machine learning models based on the training set and the test set, the machine learning model that produces the highest classification accuracy in training and testing can be used (e.g., by the machine learning system 115) as the misleading traffic event machine learning model. In addition, feature selection techniques, such as chi-squared statistic, information gain, gini index, etc., can be used to determine the highest ranked features from the set based on the context feature's contribution to classification effectiveness.

In other embodiments, ground truth misleading traffic event data can be more specialized than what is prescribed in the matrix/table 800. For instance, the ground truth could be specific out-of-sequence misleading traffic events. In the absence of one or more sets of the features 801-809, the model can still function using the available features.

In one embodiment, the misleading traffic event machine learning model can learn from one or more feedback loops based on, for example, vehicle behavior data and/or feedback data (e.g., from users), via analyzing and reflecting how misleading traffic event conflicts were generated, etc. The misleading traffic event machine learning model can learn the cause(s), for example, based on the misleading traffic event categories, to identify misleading traffic events and to add new misleading traffic events/features into the model based on this learning.

In other embodiments, the machine learning system 115 can train the misleading traffic event machine learning model to select or assign respective weights, correlations, relationships, etc. among the features 801-811, to identify misleading traffic events and to add new misleading traffic events/features into the model. In one instance, the machine learning system 115 can continuously provide and/or update the machine learning models (e.g., a support vector machine (SVM), neural network, decision tree, etc.) of the machine learning system 115 during training using, for instance, supervised deep convolution networks or equivalents. In other words, the machine learning system 115 trains the machine learning models using the respective weights of the features to most efficiently select optimal action(s) to take for different misleading traffic event scenarios in different geographic areas (e.g., streets, city, country, region, etc.).

In another embodiment, the machine learning system 115 of the traffic platform 107 includes a neural network or other machine learning system(s) to update enhanced features in different geographic areas. In one embodiment, the neural network of the machine learning system 115 is a traditional convolutional neural network which consists of multiple layers of collections of one or more neurons (which are configured to process a portion of an input data). In one embodiment, the machine learning system 115 also has connectivity or access over the communication network 109 to the probe database 113 and/or the geographic database 111 that can each store map data, the feature data, the output data, etc.

The above-discussed embodiments can be applied to increase map accuracy and/or travel safety in different geographic areas.

Figure 9:
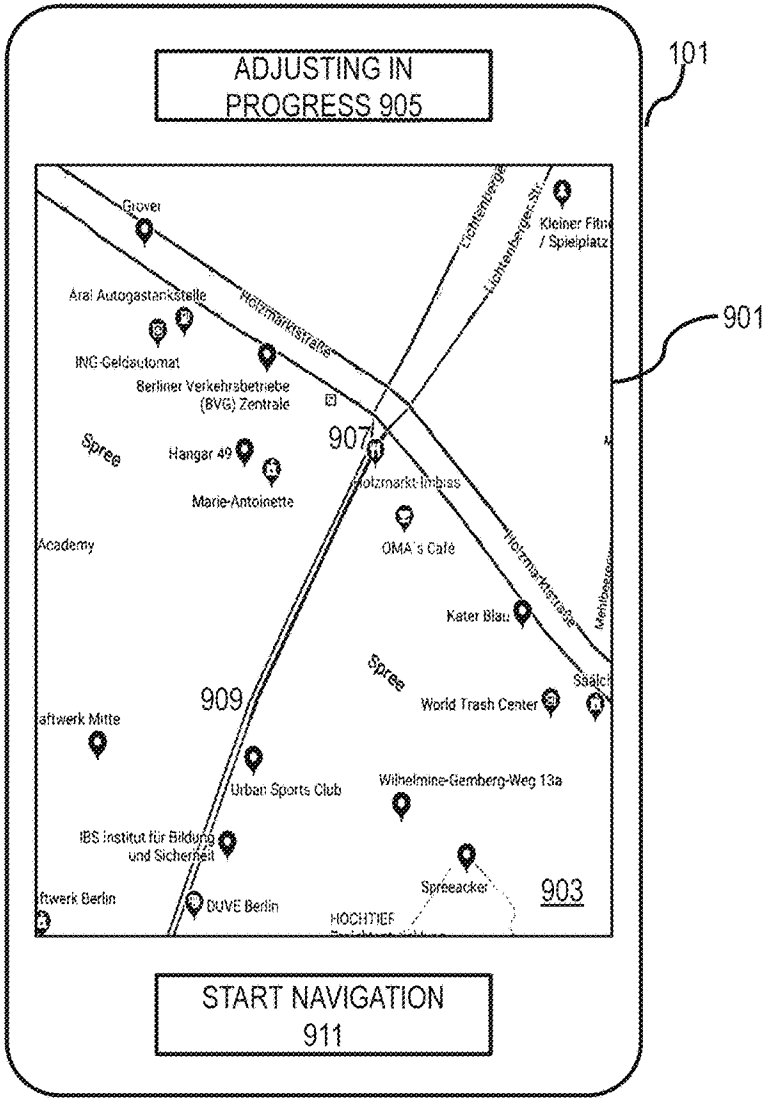
FIG. 9 is a diagram of an example user interface capable of preventing traffic over-reporting via identifying misleading traffic data, according to one or more example embodiments.

FIG. 9 is a diagram of an example user interface (UI) 901 (e.g., of a navigation application 111) capable of preventing traffic over-reporting via identifying misleading traffic data, according to one or more example embodiments. In this example, the UI 901 shown is generated for a UE 101 (e.g., a mobile device, an embedded navigation system, a client terminal, etc.) that includes a map 903, and a status indication 905 of "Adjusting in progress" that the system 100 is monitoring probe devices in the area to spot misleading traffic event(s), such as a person carrying a relative large number of probe devices (e.g., more than two in a handcart, backpack, etc.) and walking slowly on a street between a starting point 907 and reaching a location 909. For instance, the system 100 can adjust a corresponding traffic report by suppressing the number of identified probe devices (e.g., more than two) into one, to prevent over-reporting. Accordingly, when a user selects an input 911 of "Start Navigation" in the area, the system 100 can adjust the otherwise misleading traffic report (e.g., slow moving congestion) based on identified misleading traffic event(s) and can provide the user accurate navigation guidance using any mode of transport (e.g., walking, riding in a vehicle, etc.) based on the adjusted traffic report. By way of example, the system 100 can provide a pedestrian navigation on a sidewalk based on the adjusted foot traffic on the sidewalk, an autonomous vehicle on a roadway based on the adjusted vehicular traffic on the roadway, etc.

In one instance, the UI 901 could also be a headset, goggle, or eyeglass device used separately or in connection with a UE 101 (e.g., a mobile device). In one embodiment, the system 100 can present or surface the output data, the adjust traffic report, etc. in multiple interfaces simultaneously (e.g., presenting a 2D map, a 3D map, an augmented reality view, a virtual reality display, or a combination thereof). In one embodiment, the system 100 could also present the output data to a user through other media including but not limited to one or more sounds, haptic feedback, touch, or other sensory interfaces. For example, the system 100 could present the output data through the speakers of a vehicle carrying the user.

In one embodiment, the traffic platform 107 may provide interactive user interfaces (e.g., associated with the UEs 101) for reporting misleading traffic events based on user inputs (e.g., crowd-sources via Mechanical Turk (MTurk)®, Crowd Flowers®, etc.). For example, the user interface can present an interactive user interface element or a physical controller such as but not limited to a knob, a joystick, a rollerball or trackball-based interface, a pressure sensor on a screen or window whose intensity reflects the movement of time, an interface that enables gestures/touch interaction, an interface that enables voice commands, or other sensors. By way of example, the other sensors (e.g., sensors 103) are any type of sensor that can detect a user's gaze, heartrate, sweat rate or perspiration level, eye movement, body movement, or combination thereof, in order to determine a user context or a response to report misleading traffic events. In one embodiment, the system 100 and the user interface element, e.g., a joystick, enable a user to report misleading traffic events (e.g., provide the system 100 with ground truth data).

In one embodiment, the system 100 can collect the sensor data, contextual data, or a combination through one or more sensors such as the sensors 103, vehicle sensors connected to the system 100 via the communication network 109 (including camera sensors, light sensors, Light Detection and Ranging (LiDAR) sensors, radar, infrared sensors, thermal sensors, and the like), etc. to determine the type/kind of the misleading traffic events.

In one embodiment, the vehicles can be autonomous vehicles or highly assisted driving (HAD) vehicles that can sense their environments and navigate within a travel network without driver or occupant input. It is contemplated the vehicle may be any type of transportation (e.g., an airplane, a drone, a train, a ferry, etc.). In one embodiment, the above-mentioned vehicle sensors acquire map data and/or sensor data when the vehicles travel on the street for detecting misleading traffic events, such as the artist dragging a handcart full of smart phones.

By way of example, the vehicle sensors may be any type of sensors that detect various context data. In certain embodiments, the vehicle sensors may include, for example, a global positioning sensor for gathering location data, a network detection sensor for detecting wireless signals or receivers for different short-range communications (e.g., Bluetooth, Wi-Fi, light fidelity (Li-Fi), near field communication (NFC) etc.), temporal information sensors, a camera/imaging sensor for gathering image data (e.g., for detecting objects proximate to the vehicles), an audio recorder for gathering audio data (e.g., detecting nearby humans or animals via acoustic signatures such as voices or animal noises), velocity sensors, and the like. In another embodiment, the vehicle sensors may include sensors (e.g., mounted along a perimeter of the vehicles) to detect the relative distance of the vehicles from any map objects/features, such as lanes or roadways, the presence of other vehicles, pedestrians, animals, traffic lights, road features (e.g., curves) and any other objects, or a combination thereof. In one scenario, the vehicle sensors may detect weather data, traffic information, or a combination thereof. In one example embodiment, the vehicles may include GPS receivers to obtain geographic coordinates from satellites 123 for determining current location and time. Further, the location can be determined by a triangulation system such as A-GPS, Cell of Origin, or other location extrapolation technologies when cellular or network signals are available. In another example embodiment, the one or more vehicle sensors may provide in-vehicle navigation services.

In one embodiment, the UEs 101 can be associated with any of the types of vehicles or a person or thing traveling within the geographic area. By way of example, the UEs 101 can be any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, fitness device, television receiver, radio broadcast receiver, electronic book device, game device, devices associated with one or more vehicles or any combination thereof, including the accessories and peripherals of these devices, or any combination thereof. It is also contemplated that the UEs 101 can support any type of interface to the user (such as "wearable" circuitry, etc.). In one embodiment, the vehicles may have cellular or wireless fidelity (Wi-Fi) connection either through the inbuilt communication equipment or from the UEs 101 associated with the vehicles. Also, the UEs 101 may be configured to access the communication network 109 by way of any known or still developing communication protocols.

In one embodiment, the traffic platform 107 has connectivity over the communication network 109 to the services platform 117 that provides the services 119 (e.g., as in FIG. 1). In another embodiment, the services platform 117 and the content providers 121 communicate directly (not shown in FIG. 1). By way of example, the services 119 may also be other third-party services and include mapping services, navigation services, travel planning services, notification services, social networking services, content (e.g., audio, video, images, etc.) provisioning services, application services, storage services, contextual information determination services, location-based services, information-based services (e.g., weather, news, etc.), etc.

In one embodiment, the content providers 121 may provide content or data (e.g., including geographic data, output data of the processes 300, 400, 600, historical mobility data, etc.). The content provided may be any type of content, such as map content, output data, audio content, video content, image content, etc. In one embodiment, the content providers 121 may also store content associated with the probe database 113, geographic database 111, traffic platform 107, services platform 117, services 119, and/or vehicles traveling on a road segment of interest. In another embodiment, the content providers 121 may manage access to a central repository of data, and offer a consistent, standard interface to data, such as a repository of the probe database 113 and/or the geographic database 111.

The communication network 109 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UNITS), etc., as well as any other suitable wireless medium, e.g., worldwide interoperability for microwave access (WiMAX), Long Term Evolution (LTE) networks, 2/3/4/5/6G networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

In one embodiment, the traffic platform 107 may be a platform with multiple interconnected components. By way of example, the traffic platform 107 may include multiple servers, intelligent networking devices, computing devices, components, and corresponding software for determining upcoming vehicle events for one or more locations based, at least in part, on signage information. In addition, it is noted that the traffic platform 107 may be a separate entity of the system 100, a part of the services platform 117, the one or more services 119, or the content providers 121.

By way of example, the vehicles traveling on the road segment of interest, the UEs 101, the traffic platform 107, the services platform 117, the services 119, and the content providers 121 communicate with each other and other components of the communication network 109 using well known, new or still developing protocols. In this context, a protocol includes a set of rules defining how the network nodes within the communication network 109 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 10:
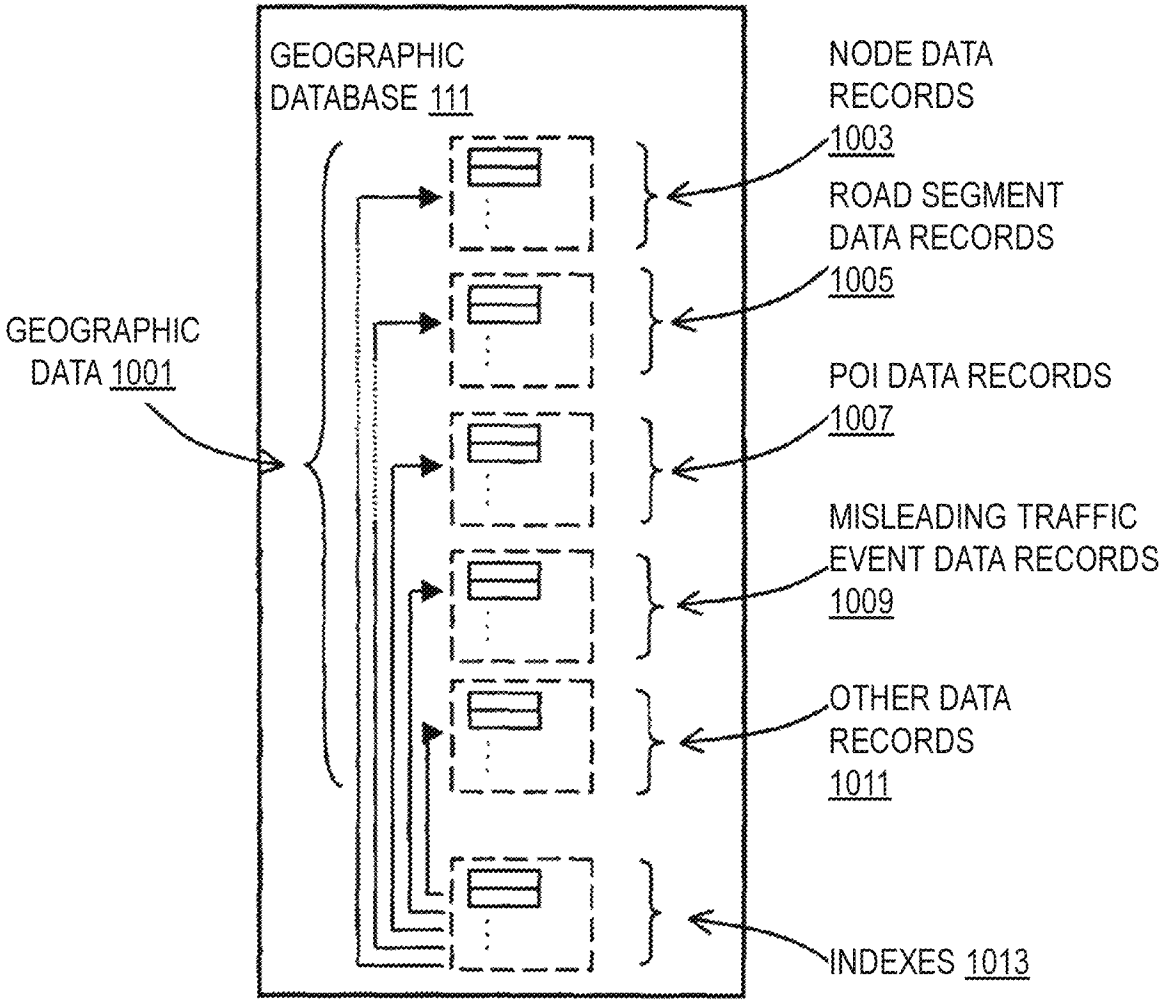
FIG. 10 is a diagram of a geographic database, according to one or more example embodiments.

FIG. 10 is a diagram of a geographic database 111, according to one or more example embodiments. In one embodiment, the geographic database 111 includes geographic data 1001 used for (or configured to be compiled to be used for) mapping and/or navigation-related services.

In one embodiment, geographic features (e.g., two-dimensional, or three-dimensional features) are represented using polygons (e.g., two-dimensional features) or polygon extrusions (e.g., three-dimensional features). For example, the edges of the polygons correspond to the boundaries or edges of the respective geographic feature. In the case of a building, a two-dimensional polygon can be used to represent a footprint of the building, and a three-dimensional polygon extrusion can be used to represent the three-dimensional surfaces of the building. It is contemplated that although various embodiments are discussed with respect to two-dimensional polygons, it is contemplated that the embodiments are also applicable to three-dimensional polygon extrusions, models, routes, etc. Accordingly, the terms polygons and polygon extrusions/models as used herein can be used interchangeably.

In one embodiment, the following terminology applies to the representation of geographic features in the geographic database 111.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the geographic database 111 follows certain conventions. For example, links do not cross themselves and do not cross each other except at a node. Also, there are no duplicated shape points, nodes, or links. Two links that connect each other have a common node. In the geographic database 111, overlapping geographic features are represented by overlapping polygons. When polygons overlap, the boundary of one polygon crosses the boundary of the other polygon. In the geographic database 111, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

As shown, the geographic data 1001 of the geographic database 111 includes node data records 1003, road segment or link data records 1005, POI data records 1007, misleading traffic event data records 1009, other data records 1011, and indexes 1013, for example. More, fewer, or different data records can be provided. In one embodiment, additional data records (not shown) can include cartographic ("carto") data records, routing data, and maneuver data. In one embodiment, the indexes 1013 may improve the speed of data retrieval operations in the geographic database 111. In one embodiment, the indexes 1013 may be used to quickly locate data without having to search every row in the geographic database 111 every time it is accessed. For example, in one embodiment, the indexes 1013 can be a spatial index of the polygon points associated with stored feature polygons.

In exemplary embodiments, the road segment data records 1005 are links or segments representing roads, streets, or paths, as can be used in the calculated route or recorded route information for determination of one or more personalized routes. The node data records 1003 are end points (such as intersections) corresponding to the respective links or segments of the road segment data records 1005. The road link data records 1005 and the node data records 1003 represent a road network, such as used by vehicles, cars, and/or other entities. In addition, the geographic database 111 can contain path segment and node data records or other data that represent 3D paths around 3D map features (e.g., terrain features, buildings, other structures, etc.) that occur above street level, such as when routing or representing flightpaths of aerial vehicles (e.g., drones), for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 111 can include data about the POIs and their respective locations in the POI data records 1007. The geographic database 111 can also include data about places, such as cities, towns, or other communities, and other geographic features, such as bodies of water, mountain ranges, etc. Such place or feature data can be part of the POI data records 1007 or can be associated with POIs or POI data records 1007 (such as a data point used for displaying or representing a position of a city).

In one embodiment, the geographic database 111 can also include misleading traffic event data records 1009 that can include distance and height analysis data, multiple clustering data, context data, misleading traffic event data, misleading traffic event category data, etc., for preventing traffic over-reporting via identifying misleading traffic data according to the embodiment described herein. In one embodiment, the misleading traffic event data records 1009 can be associated with one or more of the node records 1003, road segment records 1005, and/or POI data records 1007 so that the output data can inherit characteristics, properties, metadata, etc. of the associated records (e.g., location, address, POI type, etc.) of the corresponding destination or POI at selected destinations.

In one embodiment, the geographic database 111 can be maintained by the services platform 117 and/or any of the services 119 of the services platform 117 (e.g., a map developer). The map developer can collect geographic data to generate and enhance the geographic database 111. There can be different ways used by the map developer to collect data. These ways can include obtaining data from other sources, such as municipalities or respective geographic authorities. In addition, the map developer can employ aerial drones (e.g., using the embodiments of the privacy-routing process described herein) or field vehicles (e.g., mapping drones or vehicles equipped with mapping sensor arrays, e.g., LiDAR) to travel along roads throughout the geographic region to observe features and/or record information about them, for example. Also, remote sensing, such as aerial or satellite photography or other sensor data, can be used.

The geographic database 111 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation capable device or vehicle. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

The processes described herein for preventing traffic over-reporting via identifying misleading traffic data may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 11:
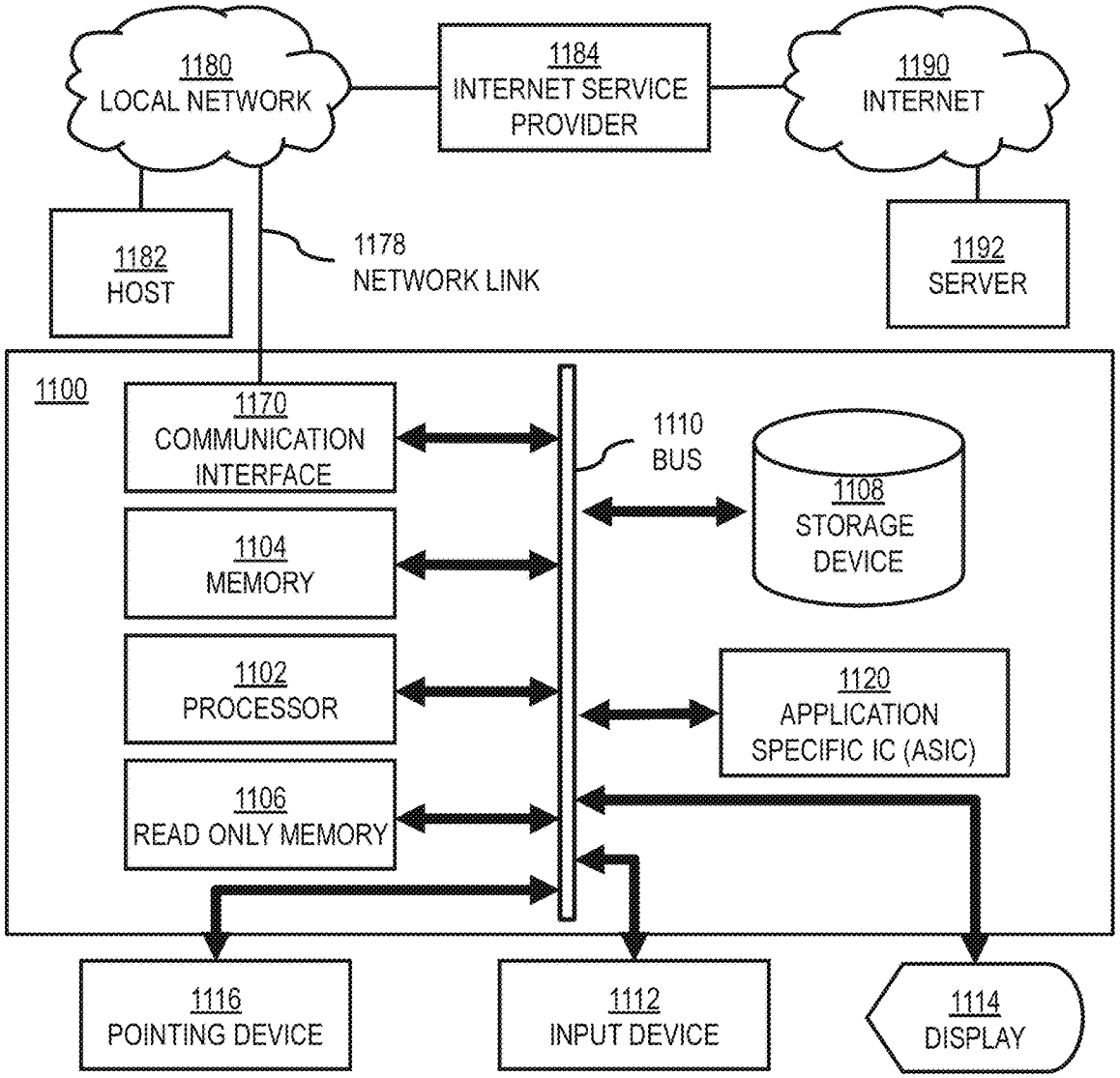
FIG. 11 is a diagram of hardware that can be used to implement an embodiment of the invention, according to one or more example embodiments.

FIG. 11 illustrates a computer system 1100 upon which an embodiment of the invention may be implemented. Computer system 1100 is programmed (e.g., via computer program code or instructions) to prevent traffic over-reporting via identifying misleading traffic data as described herein and includes a communication mechanism such as a bus 1110 for passing information between other internal and external components of the computer system 1100. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 1110 includes one or more parallel conductors of information so that information is transferred quickly among devices coupled to the bus 1110. One or more processors 1102 for processing information are coupled with the bus 1110.

A processor 1102 performs a set of operations on information as specified by computer program code related to preventing traffic over-reporting via identifying misleading traffic data. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 1110 and placing information on the bus 1110. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 1102, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 1100 also includes a memory 1104 coupled to bus 1110. The memory 1104, such as a random access memory (RANI) or other dynamic storage device, stores information including processor instructions for preventing traffic over-reporting via identifying misleading traffic data. Dynamic memory allows information stored therein to be changed by the computer system 1100. RANI allows a unit of information stored at a location called a memory address to be stored and retrieved independently of information at neighboring addresses. The memory 1104 is also used by the processor 1102 to store temporary values during execution of processor instructions. The computer system 1100 also includes a read only memory (ROM) 1106 or other static storage device coupled to the bus 1110 for storing static information, including instructions, that is not changed by the computer system 1100. Some memory is composed of volatile storage that loses the information stored thereon when power is lost. Also coupled to bus 1110 is a non-volatile (persistent) storage device 1108, such as a magnetic disk, optical disk or flash card, for storing information, including instructions, that persists even when the computer system 1100 is turned off or otherwise loses power.

Information, including instructions for preventing traffic over-reporting via identifying misleading traffic data, is provided to the bus 1110 for use by the processor from an external input device 1112, such as a keyboard containing alphanumeric keys operated by a human user, or a sensor. A sensor detects conditions in its vicinity and transforms those detections into physical expression compatible with the measurable phenomenon used to represent information in computer system 1100. Other external devices coupled to bus 1110, used primarily for interacting with humans, include a display device 1114, such as a cathode ray tube (CRT) or a liquid crystal display (LCD), or plasma screen or printer for presenting text or images, and a pointing device 1116, such as a mouse or a trackball or cursor direction keys, or motion sensor, for controlling a position of a small cursor image presented on the display 1114 and issuing commands associated with graphical elements presented on the display 1114. In some embodiments, for example, in embodiments in which the computer system 1100 performs all functions automatically without human input, one or more of external input device 1112, display device 1114 and pointing device 1116 is omitted.

In the illustrated embodiment, special purpose hardware, such as an application specific integrated circuit (ASIC) 1120, is coupled to bus 1110. The special purpose hardware is configured to perform operations not performed by processor 1102 quickly enough for special purposes. Examples of application specific ICs include graphics accelerator cards for generating images for display 1114, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 1100 also includes one or more instances of a communications interface 1170 coupled to bus 1110. Communication interface 1170 provides a one-way or two-way communication coupling to a variety of external devices that operate with their own processors, such as printers, scanners and external disks. In general the coupling is with a network link 1178 that is connected to a local network 1180 to which a variety of external devices with their own processors are connected. For example, communication interface 1170 may be a parallel port or a serial port or a universal serial bus (USB) port on a personal computer. In some embodiments, communications interface 1170 is an integrated services digital network (ISDN) card or a digital subscriber line (DSL) card or a telephone modem that provides an information communication connection to a corresponding type of telephone line. In some embodiments, a communication interface 1170 is a cable modem that converts signals on bus 1110 into signals for a communication connection over a coaxial cable or into optical signals for a communication connection over a fiber optic cable. As another example, communications interface 1170 may be a local area network (LAN) card to provide a data communication connection to a compatible LAN, such as Ethernet. Wireless links may also be implemented. For wireless links, the communications interface 1170 sends or receives or both sends and receives electrical, acoustic or electromagnetic signals, including infrared and optical signals, that carry information streams, such as digital data. For example, in wireless handheld devices, such as mobile telephones like cell phones, the communications interface 1170 includes a radio band electromagnetic transmitter and receiver called a radio transceiver. In certain embodiments, the communications interface 1170 enables connection between the UE 101 and the communication network 109 for preventing traffic over-reporting via identifying misleading traffic data.

The term computer-readable medium is used herein to refer to any medium that participates in providing information to processor 1102, including instructions for execution. Such a medium may take many forms, including, but not limited to, non-volatile media, volatile media and transmission media. Non-volatile media include, for example, optical or magnetic disks, such as storage device 1108. Volatile media include, for example, dynamic memory 1104. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

Network link 1178 typically provides information communication using transmission media through one or more networks to other devices that use or process the information. For example, network link 1178 may provide a connection through local network 1180 to a host computer 1182 or to equipment 1184 operated by an Internet Service Provider (ISP). ISP equipment 1184 in turn provides data communication services through the public, world-wide packet-switching communication network of networks now commonly referred to as the Internet 1190.

A computer called a server host 1192 connected to the Internet hosts a process that provides a service in response to information received over the Internet. For example, server host 1192 hosts a process that provides information representing video data for presentation at display 1114. It is contemplated that the components of system can be deployed in various configurations within other computer systems, e.g., host 1182 and server 1192.

FIG. 12 illustrates a chip set 1200 upon which an embodiment of the invention may be implemented. Chip set 1200 is programmed to prevent traffic over-reporting via identifying misleading traffic data as described herein and includes, for instance, the processor and memory components described with respect to FIG. 11 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1200 includes a communication mechanism such as a bus 1201 for passing information among the components of the chip set 1200. A processor 1203 has connectivity to the bus 1201 to execute instructions and process information stored in, for example, a memory 1205. The processor 1203 may include one or more processing cores with each core configured to perform independently. A multi-core processor enables multiprocessing within a single physical package. Examples of a multi-core processor include two, four, eight, or greater numbers of processing cores. Alternatively or in addition, the processor 1203 may include one or more microprocessors configured in tandem via the bus 1201 to enable independent execution of instructions, pipelining, and multithreading. The processor 1203 may also be accompanied with one or more specialized components to perform certain processing functions and tasks such as one or more digital signal processors (DSP) 1207, or one or more application-specific integrated circuits (ASIC) 1209. A DSP 1207 typically is configured to process real-world signals (e.g., sound) in real time independently of the processor 1203. Similarly, an ASIC 1209 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1203 and accompanying components have connectivity to the memory 1205 via the bus 1201. The memory 1205 includes both dynamic memory (e.g., RAM, magnetic disk, writable optical disk, etc.) and static memory (e.g., ROM, CD-ROM, etc.) for storing executable instructions that when executed perform the inventive steps described herein to prevent traffic over-reporting via identifying misleading traffic data. The memory 1205 also stores the data associated with or generated by the execution of the inventive steps.

Figure 13:
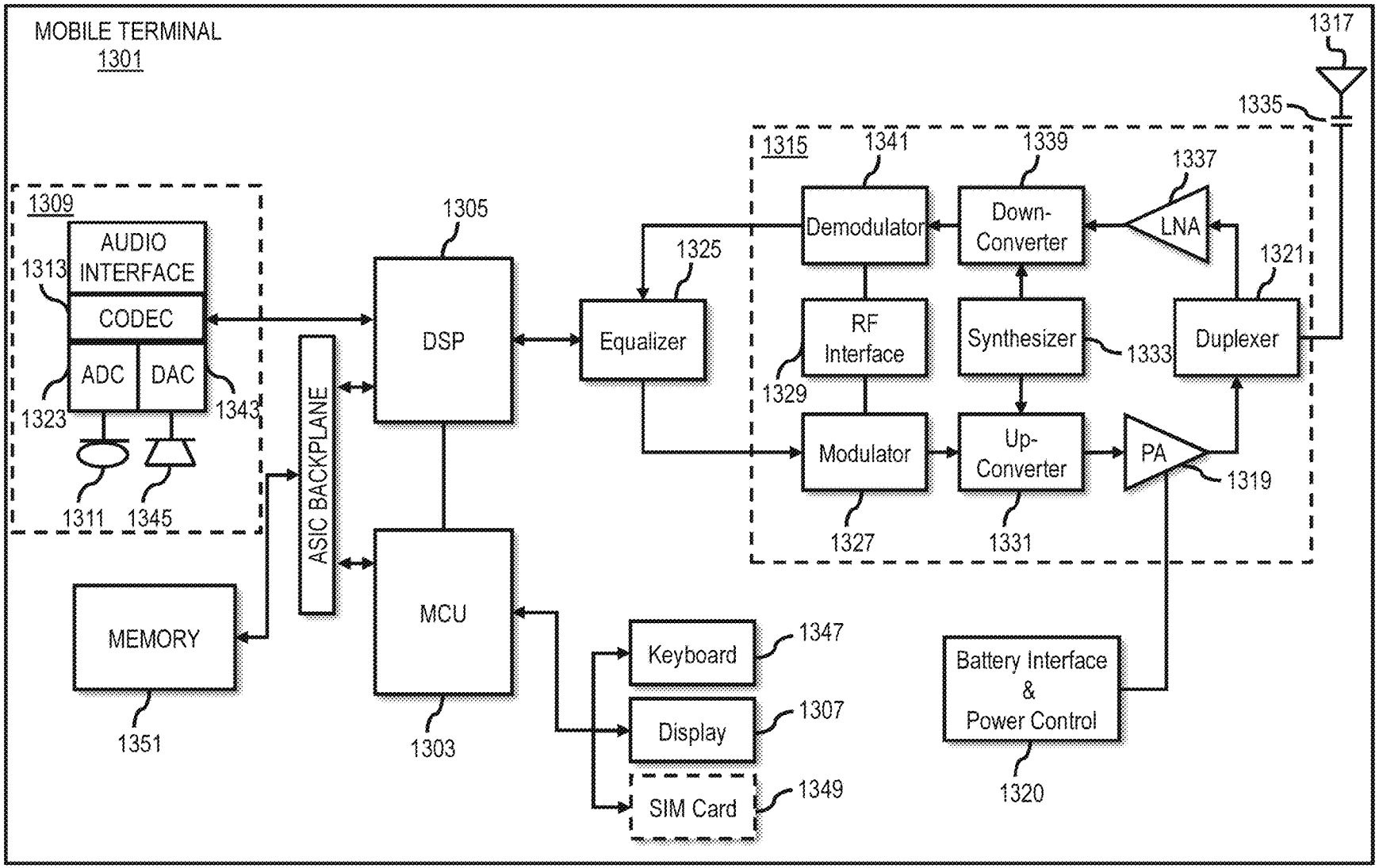
FIG. 13 is a diagram of a mobile terminal (e.g., handset) that can be used to implement an embodiment of the invention.

FIG. 13 is a diagram of exemplary components of a mobile terminal 1301 (e.g., handset) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1303, a Digital Signal Processor (DSP) 1305, and a receiver/transmitter unit including a microphone gain control unit and a speaker gain control unit. A main display unit 1307 provides a display to the user in support of various applications and mobile station functions that offer automatic contact matching. An audio function circuitry 1309 includes a microphone 1311 and microphone amplifier that amplifies the speech signal output from the microphone 1311. The amplified speech signal output from the microphone 1311 is fed to a coder/decoder (CODEC) 1313.

A radio section 1315 amplifies power and converts frequency in order to communicate with a base station, which is included in a mobile communication system, via antenna 1317. The power amplifier (PA) 1319 and the transmitter/modulation circuitry are operationally responsive to the MCU 1303, with an output from the PA 1319 coupled to the duplexer 1321 or circulator or antenna switch, as known in the art. The PA 1319 also couples to a battery interface and power control unit 1320.

In use, a user of mobile station 1301 speaks into the microphone 1311 and his or her voice along with any detected background noise is converted into an analog voltage. The analog voltage is then converted into a digital signal through the Analog to Digital Converter (ADC) 1323. The control unit 1303 routes the digital signal into the DSP 1305 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UNITS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1325 for compensation of any frequency-dependent impairments that occur during transmission though the air such as phase and amplitude distortion. After equalizing the bit stream, the modulator 1327 combines the signal with a RF signal generated in the RF interface 1329. The modulator 1327 generates a sine wave by way of frequency or phase modulation. In order to prepare the signal for transmission, an up-converter 1331 combines the sine wave output from the modulator 1327 with another sine wave generated by a synthesizer 1333 to achieve the desired frequency of transmission. The signal is then sent through a PA 1319 to increase the signal to an appropriate power level. In practical systems, the PA 1319 acts as a variable gain amplifier whose gain is controlled by the DSP 1305 from information received from a network base station. The signal is then filtered within the duplexer 1321 and optionally sent to an antenna coupler 1335 to match impedances to provide maximum power transfer. Finally, the signal is transmitted via antenna 1317 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1301 are received via antenna 1317 and immediately amplified by a low noise amplifier (LNA) 1337. A down-converter 1339 lowers the carrier frequency while the demodulator 1341 strips away the RF leaving only a digital bit stream. The signal then goes through the equalizer 1325 and is processed by the DSP 1305. A Digital to Analog Converter (DAC) 1343 converts the signal and the resulting output is transmitted to the user through the speaker 1345, all under control of a Main Control Unit (MCU) 1303—which can be implemented as a Central Processing Unit (CPU) (not shown).

The MCU 1303 receives various signals including input signals from the keyboard 1347. The keyboard 1347 and/or the MCU 1303 in combination with other user input components (e.g., the microphone 1311) comprise a user interface circuitry for managing user input. The MCU 1303 runs a user interface software to facilitate user control of at least some functions of the mobile station 1301 to prevent traffic over-reporting via identifying misleading traffic data. The MCU 1303 also delivers a display command and a switch command to the display 1307 and to the speech output switching controller, respectively. Further, the MCU 1303 exchanges information with the DSP 1305 and can access an optionally incorporated SIM card 1349 and a memory 1351. In addition, the MCU 1303 executes various control functions required of the station. The DSP 1305 may, depending upon the implementation, perform any of a variety of conventional digital processing functions on the voice signals. Additionally, DSP 1305 determines the background noise level of the local environment from the signals detected by microphone 1311 and sets the gain of microphone 1311 to a level selected to compensate for the natural tendency of the user of the mobile station 1301.

The CODEC 1313 includes the ADC 1323 and DAC 1343. The memory 1351 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1351 may be, but not limited to, a single memory, CD, DVD, ROM, RAM, EEPROM, optical storage, or any other non-volatile or non-transitory storage medium capable of storing digital data.

An optionally incorporated SIM card 1349 carries, for instance, important information, such as the cellular phone number, the carrier supplying service, subscription details, and security information. The SIM card 1349 serves primarily to identify the mobile station 1301 on a radio network. The card 1349 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method comprising:

detecting a connection attempt between a wireless communication infrastructure device and a plurality of probe devices, wherein the wireless communication infrastructure device is associated with a known height;

processing one or more wireless signals associated with the connection attempt to determine height data of the plurality of probe devices;

determining based on the height data that at least two of the plurality of probe devices are carried by a single entity; and providing data indicating the at least two of the plurality of probe devices as an output.

2. The method of claim 1, further comprising:

adjusting one or more traffic events, one or more map events, or a combination thereof determined from probe data collected from the plurality of probe devices based on the data indicating the at least two of the plurality of probe devices.

3. The method of claim 2, further comprising:

processing the one or more wireless signals to determine distance data and speed data of the plurality of probe devices, wherein the data indicating the at least two of the plurality of probe devices is further based on the distance data and the speed data.

4. The method of claim 3, further comprising:

determining a location per probe device as located on a roadway portion, a bicycle lane portion, or a sidewalk portion of the road segment; and determining a mode of transport per probe device based on the location, the height data, the distance data, the speed data, or a combination thereof.

5. The method of claim 4, further comprising:

clustering the plurality of probe devices per mode of transport, wherein the data indicating the at least two of the plurality of probe devices is further based on the mode of transport, the clustering, or a combination thereof.

6. The method of claim 5, wherein the mode of transport includes walking, car, bus, truck, or bicycle.

7. The method of claim 2, wherein the adjustment associates the one or more traffic events, one or more map events, or a combination thereof as with one instead of the at least two of the plurality of probe devices.

8. The method of claim 1, further comprising:

processing sensor data from the plurality of probe devices to determine one or more signatures shared by a portion of the plurality of probe devices, wherein the data indicating the at least two of the plurality of probe devices is further based on the one or more signatures.

9. The method of claim 8, wherein the one or more signatures include a speed, a vibration, a noise, a distance, a height, an angle of rotation from the wireless communication infrastructure device, or a combination thereof of the portion of the plurality of probe devices.

10. The method of claim 1, further comprising:

retrieving online or offline location data of the wireless communication infrastructure device indexed in map data, wherein the height data of the plurality of probe devices is further determined based on the location data of the wireless communication infrastructure device.

11. The method of claim 1, wherein the wireless communication infrastructure device includes a wireless network access point, a Bluetooth beacon, a 5G beacon, a fiber wire, acellular tower, or a combination thereof.

12. An apparatus comprising:

at least one processor; and at least one memory including computer program code for one or more programs, the at least one memory and the computer program code configured to, with the at least one processor, cause the apparatus to perform at least the following, map-match probe data associated with a plurality of probe devices to a road segment;

perform a z-axis clustering on the probe data;

determine based on z-axis clustered probe data that at least two of the plurality of probe devices are carried by a single entity; and provide data indicating the at least two of the plurality of probe devices as an output.

13. The apparatus of claim 12, wherein the apparatus is caused to:

adjust one or more traffic events, one or more map events, or a combination thereof determined from the probe data based on the data indicating the at least two of the plurality of probe devices.

14. The apparatus of claim 13, wherein the apparatus is caused to:

perform a distance clustering and a speed clustering on the z-axis clustered probe data, wherein the data indicating the at least two of the plurality of probe devices is further based on the distance and speed clustered probe data.

15. The apparatus of claim 14, wherein the apparatus is caused to:

perform a mode of transport (MOT) clustering on the distance and speed clustered probe data, wherein the data indicating the at least two of the plurality of probe devices is further based on the MOT-clustered probe data.

16. The apparatus of claim 15, wherein the apparatus is caused to:

determine a confidence factor for the data indicating the at least two of the plurality of probe devices based on the distance clustering, the z-axis clustering, the speed clustering, the MOT clustering, or a combination thereof, wherein the output includes the confidence factor.

17. The apparatus of claim 13, wherein the adjustment associates the one or more traffic events, one or more map events, or a combination thereof as with one instead of the at least two of the plurality of probe devices.

18. A non-transitory computer-readable storage medium, carrying one or more sequences of one or more instructions which, when executed by one or more processors, cause an apparatus to at least perform the following steps:

determining a mode of transport per probe device for a plurality of probe devices based on one or more broadcasting signals, height data, or a combination thereof associated with the plurality of probe devices;

determining based on the mode of transport that at least two of the plurality of probe devices are carried by a single entity; and providing data indicating the at least two of the plurality of probe devices as an output.

19. The non-transitory computer-readable storage medium of claim 18, wherein the apparatus is caused to further perform:

adjusting one or more traffic events, one or more map events, or a combination thereof determined from probe data collected from the plurality of probe devices based on the data indicating the at least two of the plurality of probe devices.

20. The non-transitory computer-readable storage medium of claim 18, wherein the apparatus is caused to further perform:

detecting a connection attempt between a wireless communication infrastructure device and the plurality of probe devices, wherein the wireless communication infrastructure device is associated with a known height; and processing one or more wireless signals associated with the connection attempt to determine the height data of the plurality of probe devices.

* * * * *